US012202658B2

(12) United States Patent
Bressan et al.

(10) Patent No.: US 12,202,658 B2
(45) Date of Patent: Jan. 21, 2025

(54) WALL AND PROCESS OF MAKING THE SAME, CHILD-PROOF PACKAGE

(71) Applicant: I.G.B. S.R.L., Milan (IT)

(72) Inventors: Alessio Bressan, Varese (IT); Michel Bressan, Induno Olona (IT); Alberto Gandolla, Induno Olona (IT)

(73) Assignee: I.G.B. S.R.L., Milan (IT)

( * ) Notice: Subject to any disclaimer, the term of this patent is extended or adjusted under 35 U.S.C. 154(b) by 240 days.

(21) Appl. No.: 17/639,806

(22) PCT Filed: Aug. 28, 2020

(86) PCT No.: PCT/IB2020/058045
§ 371 (c)(1),
(2) Date: Mar. 2, 2022

(87) PCT Pub. No.: WO2021/044269
PCT Pub. Date: Mar. 11, 2021

(65) Prior Publication Data

US 2022/0324610 A1 Oct. 13, 2022

(30) Foreign Application Priority Data

Sep. 2, 2019 (IT) ..... 102019000015354
Sep. 2, 2019 (IT) ..... 102019000015399
(Continued)

(51) Int. Cl.
*B65D 5/68* (2006.01)

(52) U.S. Cl.
CPC ..... *B65D 5/685* (2013.01); *B65D 2215/04* (2013.01)

(58) Field of Classification Search
CPC ..... B65D 5/685; B65D 2215/04; B65D 2215/02; B65D 5/38; B65D 2215/00; B65D 5/2057; B65D 5/5007; B31B 2120/60
(Continued)

(56) References Cited

U.S. PATENT DOCUMENTS 1,130,271 A 3/1915 Hammond
1,253,489 A 1/1918 Houghland
(Continued)

FOREIGN PATENT DOCUMENTS

CH 710519 6/2016
CN 204642380 9/2015
(Continued)

OTHER PUBLICATIONS

International Search Report and Written Opinion of the ISA for PCT/IB2020/058045 dated Jan. 15, 2021, 25 pages.
(Continued)

*Primary Examiner* — Christopher R Demeree
(74) *Attorney, Agent, or Firm* — Nixon & Vanderhye P.C.

(57) ABSTRACT

A wall (60) made of sheet material including an outer panel (61) having a through opening (61*a*), an inner panel (62) engaged with the outer panel (61) and a through opening (62*a*). The wall includes a selector (90) engaged in interposition between the outer panel and the inner panel. The selector includes a through opening (91) and is moveable relative to the outer and inner panels between: a first operative position wherein the through opening of the selector faces the through openings of the outer and inner panels to define, essentially with the latter through openings, a single passage passing through the wall; a second operative position wherein the through opening of the selector is offset with respect to the through openings of the outer and inner
(Continued)

panels to prevent the communication between the through openings of the outer and inner panels.

16 Claims, 16 Drawing Sheets

(30) Foreign Application Priority Data

Sep. 2, 2019 (IT) ..... 102019000015410
Nov. 4, 2019 (IT) ..... 102019000020266

(58) Field of Classification Search
USPC ..... 229/125.26, 125.28, 125.29; 206/1.5, 206/468, 267; 70/63
See application file for complete search history.

(56) References Cited

U.S. PATENT DOCUMENTS

| | | | | |
|---|---|---|---|---|
| 1,959,649 | A * | 5/1934 | Trogman | B65D 5/685 229/125.28 |
| 2,579,346 | A | 12/1951 | Theander | |
| 2,652,969 | A | 9/1953 | Pfaff | |
| 2,711,282 | A | 6/1955 | D'Esposito | |
| 2,777,630 | A | 1/1957 | Moberger | |
| 3,116,007 | A | 12/1963 | D'Esposito et al. | |
| 3,692,231 | A | 9/1972 | Neitzke et al. | |
| 3,860,111 | A | 1/1975 | Thompson | |
| 4,053,100 | A | 10/1977 | Baptist | |
| 6,296,175 | B1 | 10/2001 | Dixon | |
| 6,394,275 | B1 | 5/2002 | Paliotta et al. | |
| 6,491,211 | B1 | 12/2002 | Evans et al. | |
| 2005/0173291 | A1 | 8/2005 | Specker et al. | |
| 2008/0217390 | A1* | 9/2008 | Sattel | B65D 83/0463 206/532 |
| 2008/0283434 | A1 | 11/2008 | Gelardi | |
| 2011/0011765 | A1* | 1/2011 | Gelardi | B65D 83/0463 206/531 |
| 2012/0234701 | A1* | 9/2012 | Albrecht | B65D 83/0463 206/1.5 |
| 2013/0140201 | A1* | 6/2013 | Ghini | B65D 85/1036 206/267 |
| 2014/0262839 | A1 | 9/2014 | Le et al. | |
| 2014/0346220 | A1 | 11/2014 | Saulas | |
| 2017/0297803 | A1 | 10/2017 | Chambers et al. | |
| 2020/0039707 | A1 | 2/2020 | Kachian et al. | |

FOREIGN PATENT DOCUMENTS

| | | |
|---|---|---|
| DE | 9214914 | 2/1993 |
| EP | 0 443 930 | 8/1991 |
| EP | 0 454 506 | 10/1991 |
| EP | 0 571 711 | 12/1993 |
| EP | 1 743 842 | 1/2007 |
| EP | 2 808 265 | 12/2014 |
| EP | 2 810 885 | 12/2014 |
| EP | 3 090 955 | 11/2016 |
| EP | 3 216 712 | 9/2017 |
| FR | 2 609 689 | 7/1988 |
| FR | 2 646 830 | 11/1990 |
| WO | 2004/052749 | 6/2004 |
| WO | 2005/068304 | 7/2005 |
| WO | 2009/038219 | 3/2009 |
| WO | 2012/112538 | 8/2012 |
| WO | 2013014462 | 1/2013 |
| WO | 2015/170203 | 11/2015 |
| WO | 2016/198978 | 12/2016 |
| WO | 2017/216662 | 12/2017 |

OTHER PUBLICATIONS

U.S. Appl. No. 17/639,488 , Office Action, Jun. 22, 2023, 21 pages.
U.S. Appl. No. 17/639,782, Office Action, May 18, 2023, 26 pages.
U.S. Appl. No. 17/639,891 Office Action, May 25, 2023, 26 pages.
U.S. Appl. No. 17/639,891, Response, Aug. 25, 2023, 23 pages.

* cited by examiner

FIG.1
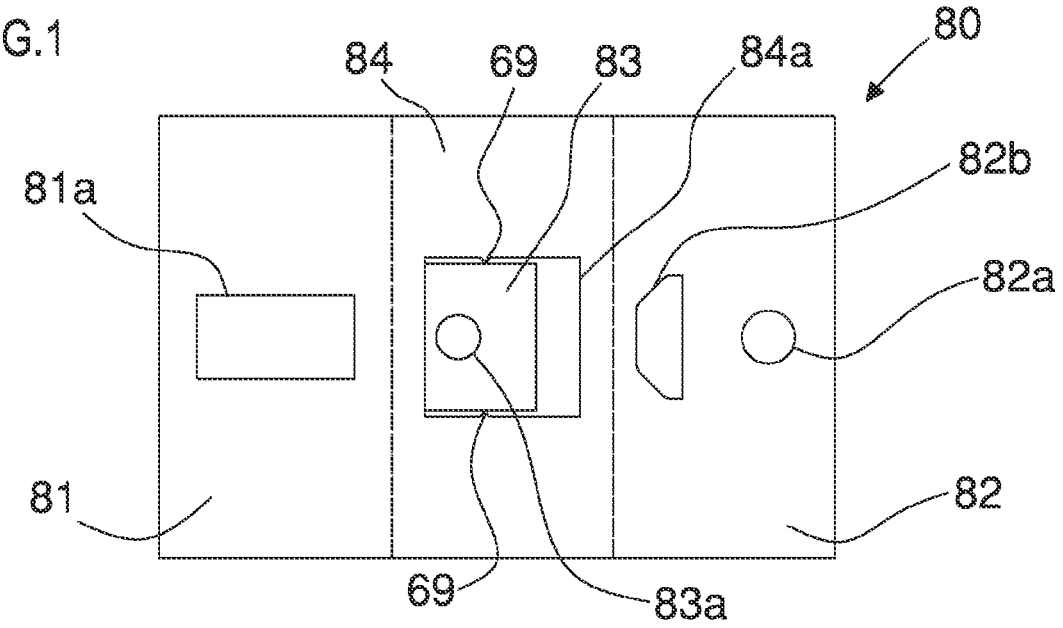
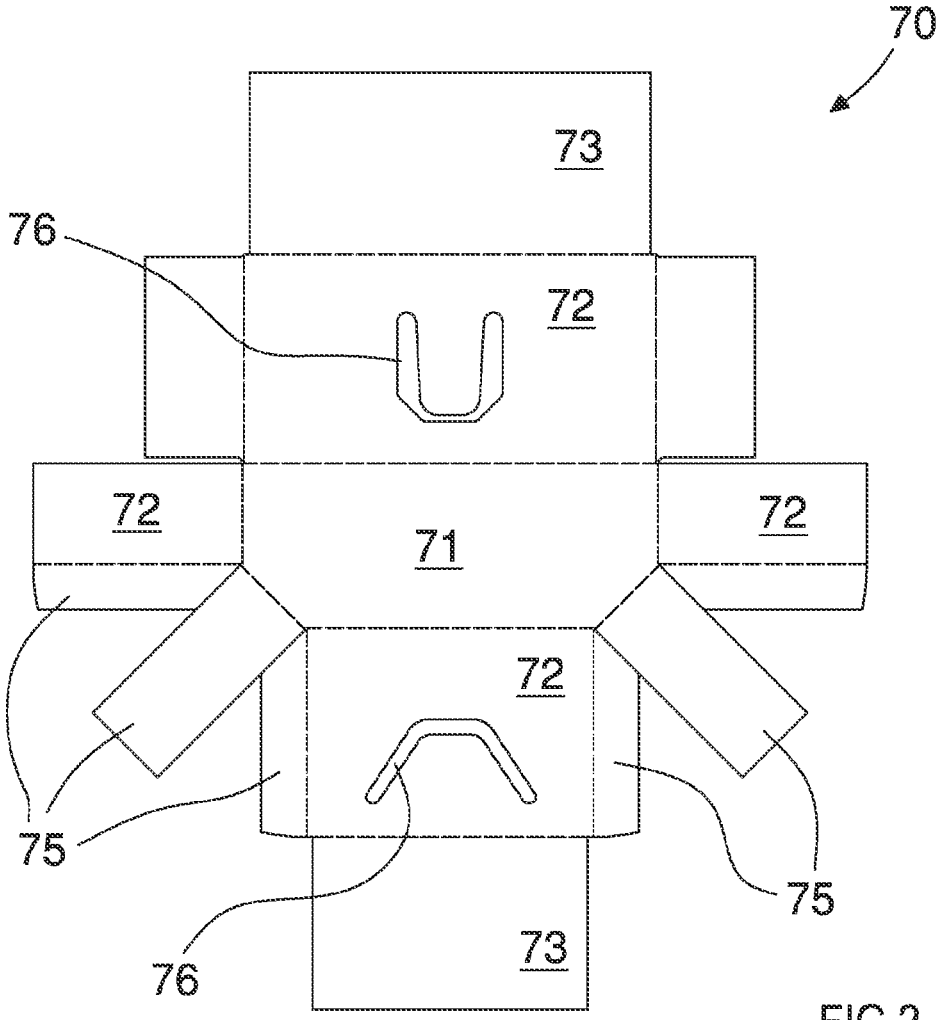
FIG.2

FIG.6
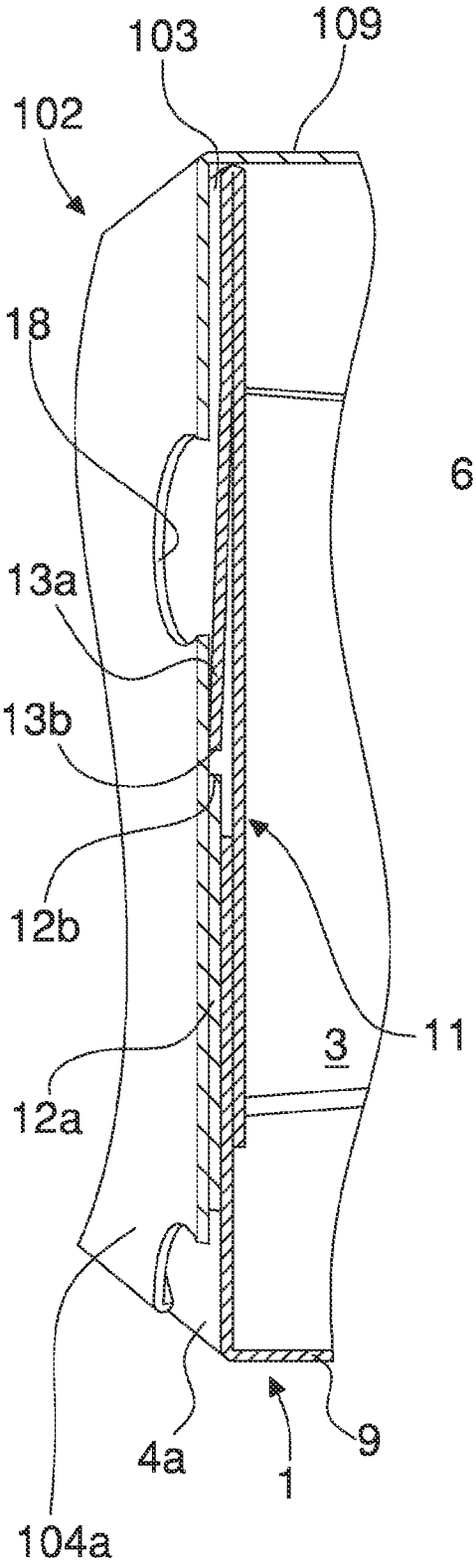
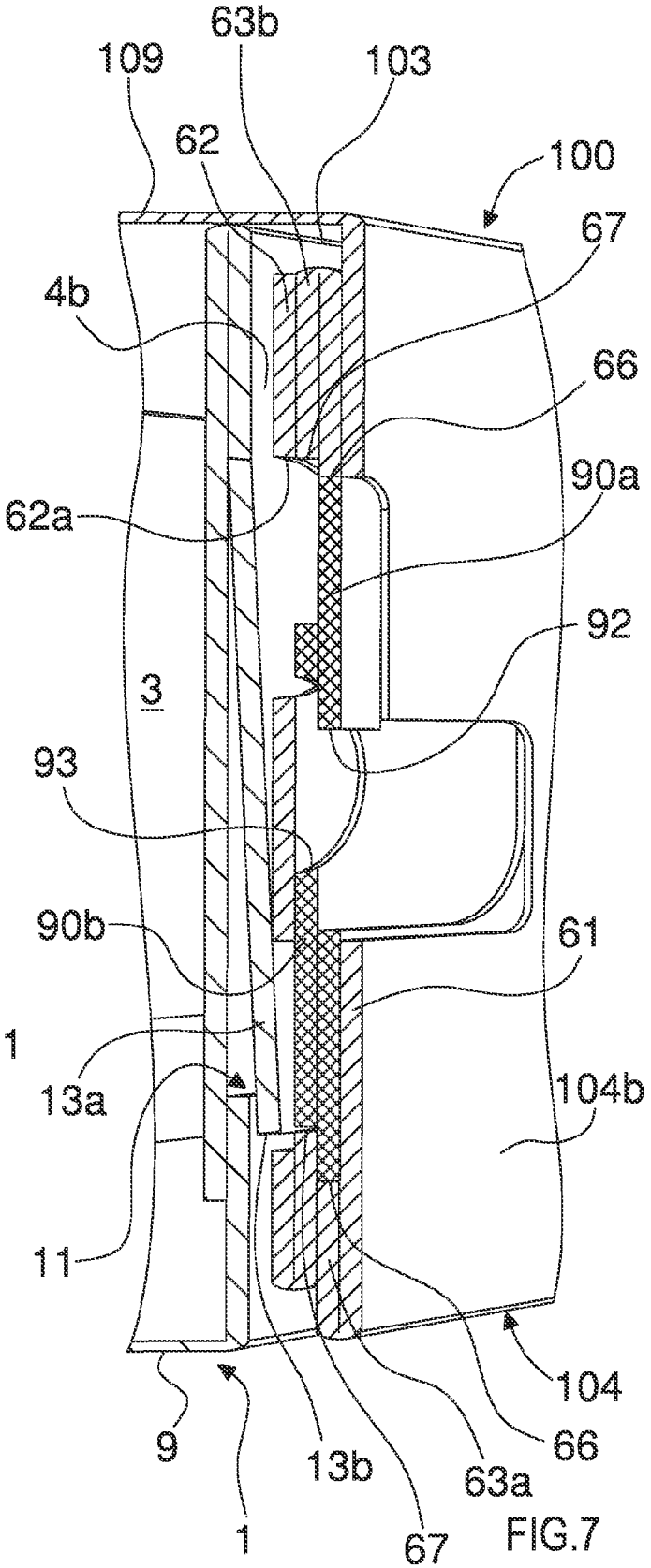
FIG.7

FIG.8
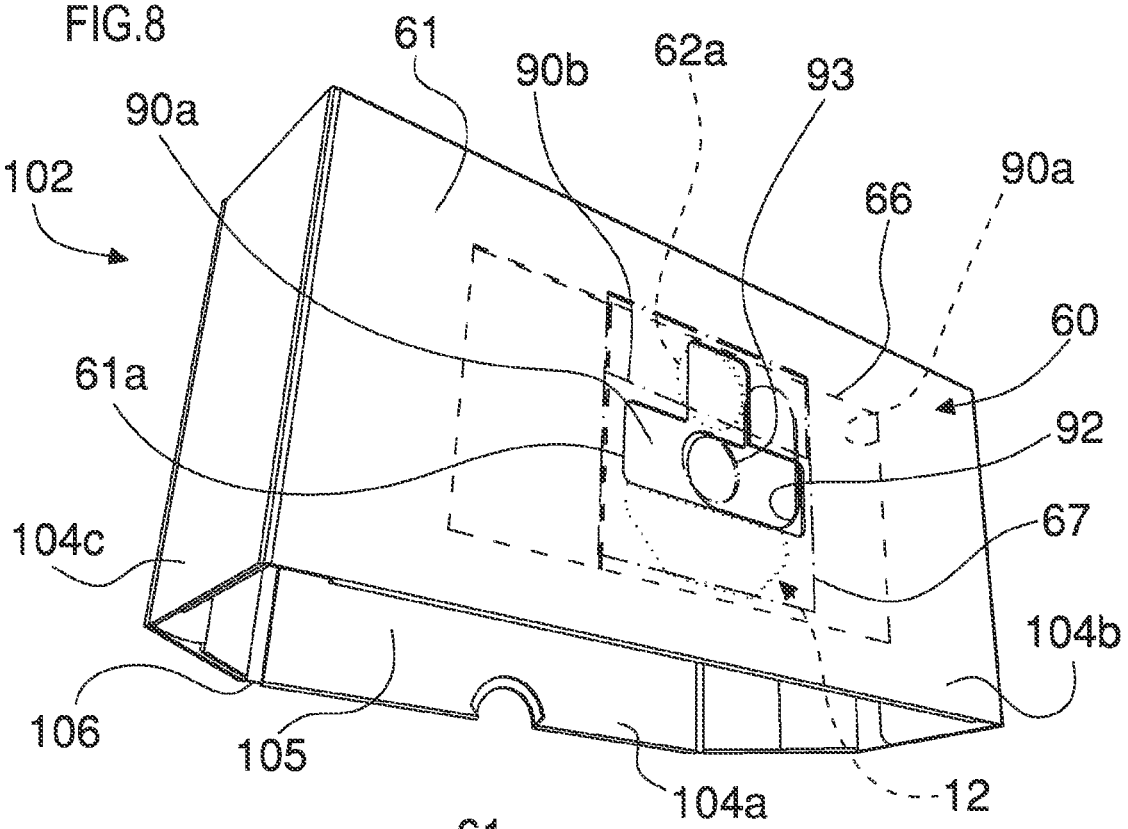
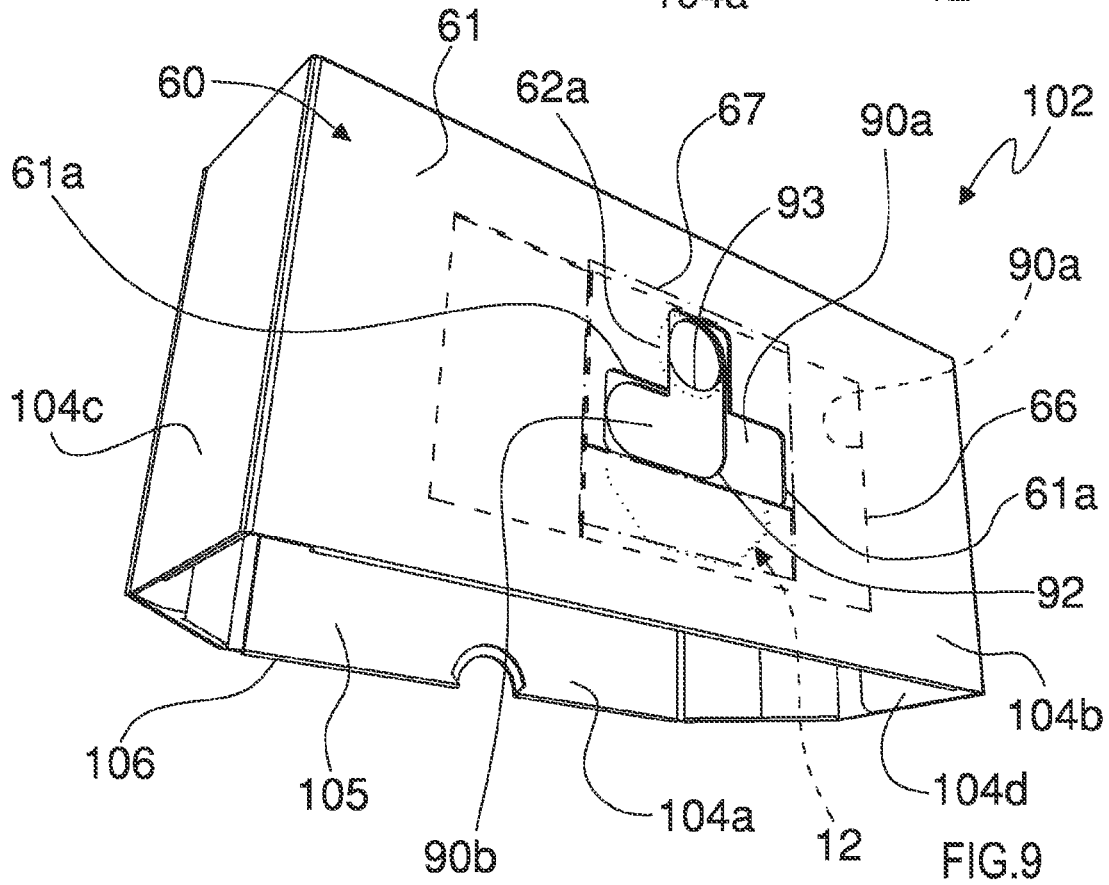
FIG.9

FIG.12
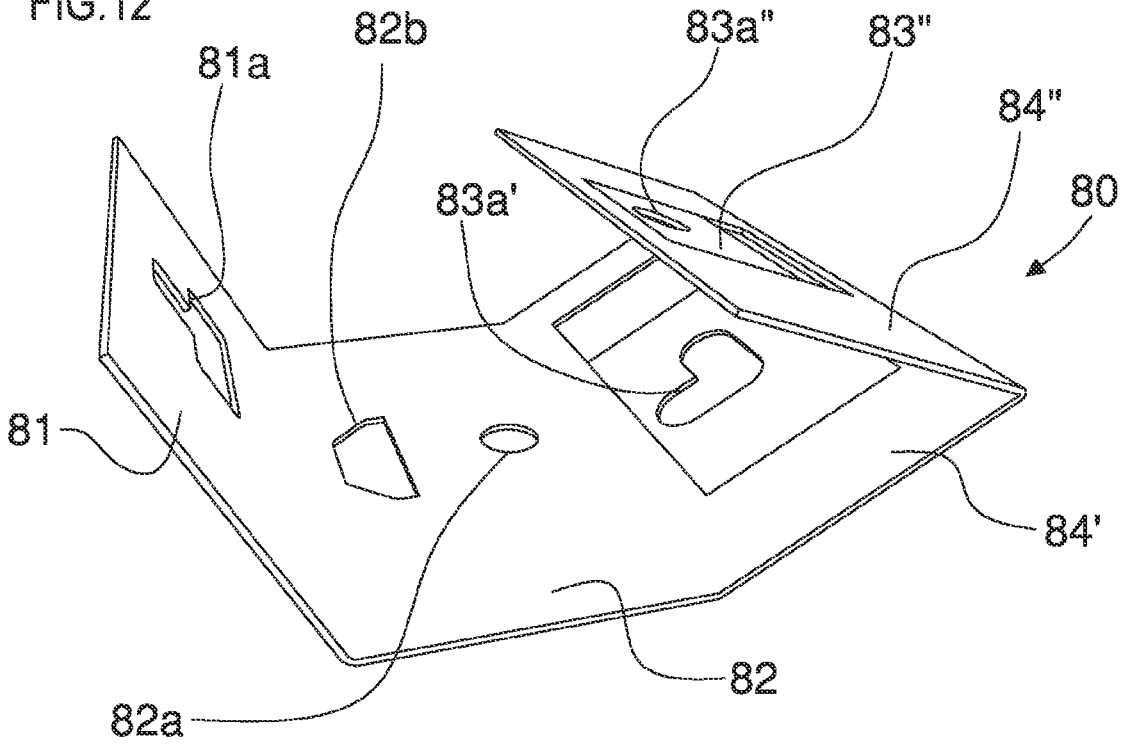
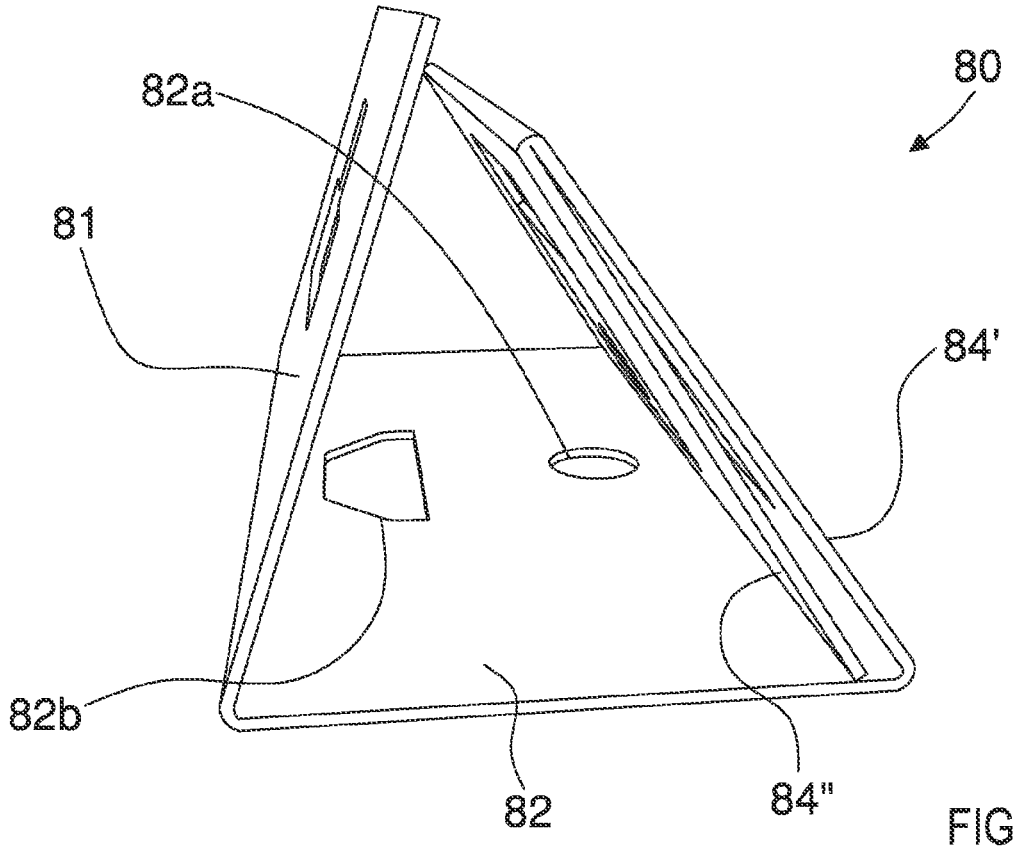
FIG.13

FIG.19
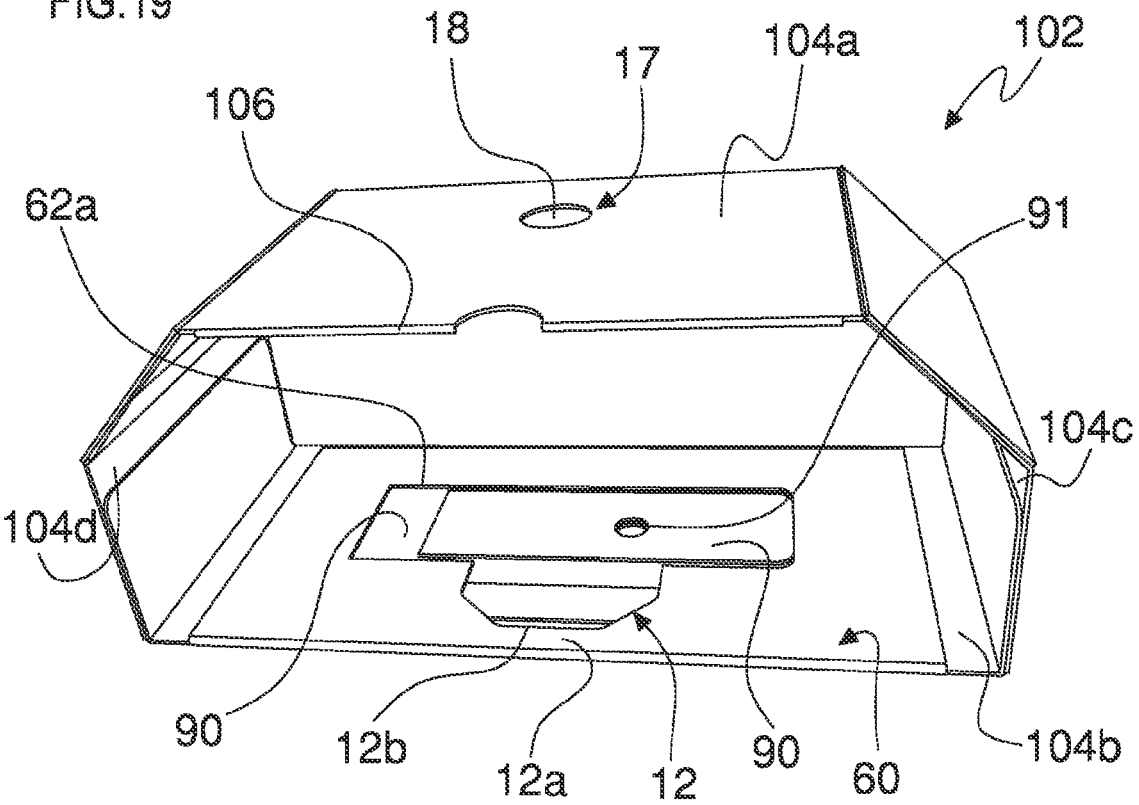
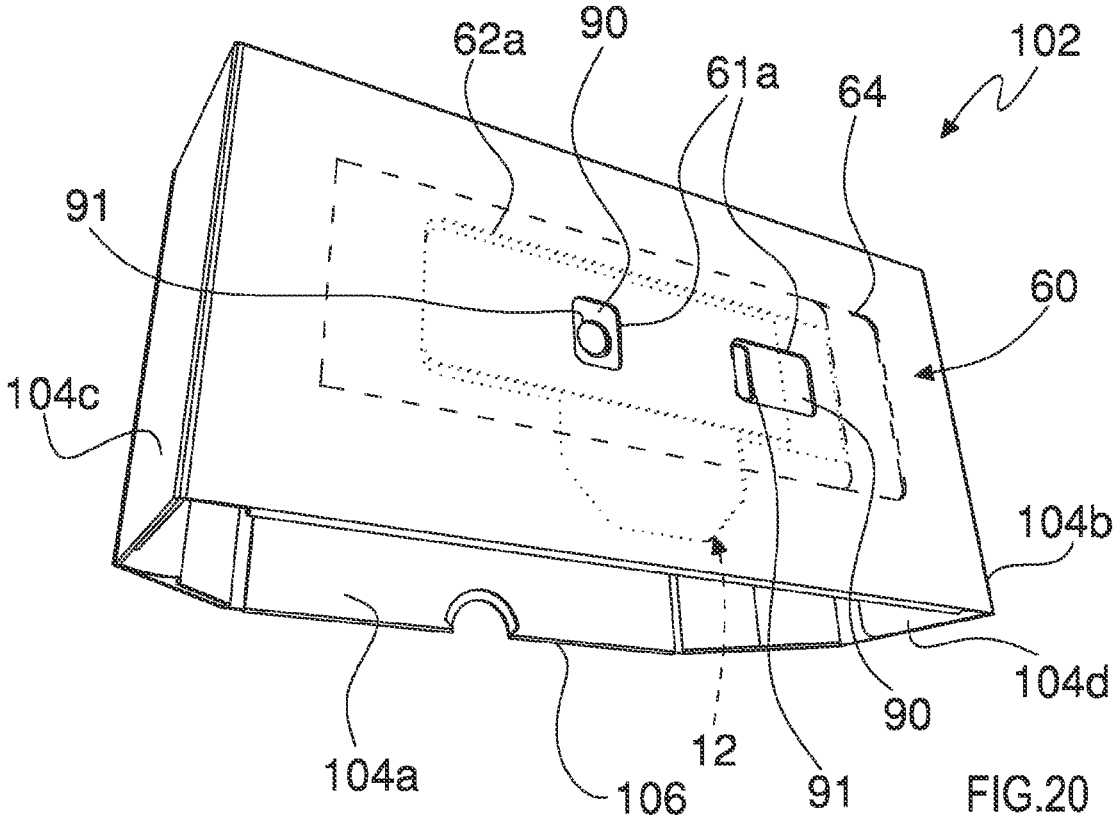
FIG.20

WALL AND PROCESS OF MAKING THE SAME, CHILD-PROOF PACKAGE

This application is the U.S. national phase of International Application PCT/IB2020/058045, filed Aug. 28, 2020, which designated the U.S. and claims priority to Italian patent applications IT 102019000015354, filed Sep. 2, 2019; IT 102019000015399, filed Sep. 2, 2019; IT 102019000015410, filed Sep. 2, 2019; and IT 102019000020266, filed Nov. 4, 2019; the entire contents of each of which are hereby incorporated by reference.

FIELD OF THE INVENTION

The object of the present invention is a wall made of sheet material, and a process for making the same, employable for making child-proof packages. The present invention also regards a child-proof package and a process for making the same, as well as a method for closing and opening the package; the package can be employed in the field of packaging for products of various kind, such as: drugs, cosmetics, cleaning products (detergents for linens/sheets and dishes), foods and tobacco-based products (cigars and cigarettes).

BACKGROUND ART

As is known, child-proof packages are available on the market that are employed for preventing young children from coming into contact with products that are potentially harmful for them. A first type of known packages is described in the following patents: US 2005/0173291 A1; EP 2 808 265 A1; U.S. Pat. No. 6,491,211 B1; WO 2005/068304 A2; US 2014/262839 A1; EP 2 810 885 A1; US 2012/234701 A1; CN 204 642 380 U; WO 2012/112538 A1; WO 2009/038219 A1; U.S. Pat. No. 1,253,489 A. Such packages have a locking system which allows maintaining such packages in a closed condition; the packages can be opened by means of intervention from outside by the user on the locking system: the intervention is allowed due to the presence of a through access defined on a lateral wall of the package. The Applicant has however detected that such known packages have a complex structure and a locking system that can be easily circumvented: such packages are not able to provide a suitable level of safety and prevent children younger than 5 from opening the package.

A second type of package is described in the patent application No. WO 2017/216662 A1. The package comprises a container for housing products recloseable by means of a case; the container and the case comprise respective coupling portions configured for being engaged with each other following a closing of the package in order to allow the locking of the container within the case and consequently preventing the removal of products. The disengagement between the case and the container occurs following the insertion of an opening device in interposition between said coupling portions. Even if the package described in the application No. WO 2017/216662 A1 is improved with respect to the packages of the first type since it is simpler structurally and more effective in terms of safety, the Applicant has also detected that such package can be improved with regard to several aspects.

Object of the Invention

Object of the present invention is therefore that of substantially resolving at least one of the drawbacks and/or limitations of the preceding solutions.

One objective of the present invention is that of providing a wall made of sheet material that is flexible in use, employable in order to define walls of packages or containers of child-proof type. A further objective of the present invention is that of providing a wall made of sheet material having a structure that is compact and simultaneously extremely strong.

One objective of the present invention is that of providing a package having a highly effective safety system capable of preventing the opening of the package by children but which at the same time can be easily openable by an adult. Another object of the present invention is to provide a package having a simple and compact structure, attainable in a quick and inexpensive manner. Another object of the present invention is to provide a package having a stable structure capable of ensuring the integrity thereof following multiple openings and closings of the same.

These and still other objects, which will be clearer from the following description, are substantially attained by a wall, a package, a process for making the wall and the package as well as a method for closing and opening the package in accordance with that expressed in one or more of the enclosed claims and/or with any one of the further aspects or characteristics described hereinbelow.

SUMMARY

In one aspect, a wall (60) is provided comprising:

an outer panel (61), optionally made of sheet material, comprising at least one through opening (61*a*), an inner panel (62), optionally made of sheet material, engaged with the outer panel (61), in which the inner panel (62) also comprises a through opening (62*a*), in which the wall (60) comprises at least one selector (90) made of sheet material engaged in interposition between the outer panel (61) and the inner panel (62).

In one aspect according to the preceding aspect the at least one selector (90) comprises at least one through opening (91). In one aspect according to any one of the preceding aspects the at least one selector (90) is configured for being moved relative to said outer panel (61) and said inner panel (62) at least between:

a first operative position in which the at least one through opening (91) of the at least one selector (90) is at least partly facing the through openings of the outer and inner panels (61, 62) so as to define with the latter through openings a single passage passing through the wall (60), a second operative position in which the through opening (91) of the selector (90) is distanced with respect to at least one of said through openings of the outer panel and of the inner panel.

In one aspect according to any one of the preceding aspects the selector (90), in the second operative position, prevents the communication between the through openings (61*a*, 62*a*) of the outer panel (61) and of the inner panel (62). In one aspect according to any one of the preceding aspects the outer panel (61) and the inner panel (62) are extended along respective development planes that are substantially parallel to each other. In one aspect according to any one of the preceding aspects the outer panel (61) and the inner panel (62) are parallel to each other.

In one aspect according to any one of the preceding aspects the selector (90) is movable between the first and second operative positions along at least one trajectory lying on a plane substantially parallel to the development planes of the outer panel (61) and/or of the inner panel (62). In one aspect according to any one of the preceding aspects the selector (90) is movable at least along a rectilinear and/or circular trajectory. In one aspect according to any one of the preceding aspects the selector (90) is arranged parallel to the outer panel and to the inner panel.

In one aspect according to any one of the preceding aspects the through opening (61*a*) of the outer panel (61) is delimited by a closed edge. In one aspect according to any one of the preceding aspects the through opening (61*a*) of the outer panel (61) is arranged at a central zone of the outer panel itself. In one aspect according to any one of the preceding aspects the through opening (61*a*) of the outer panel (61) has a rectangular or circular shape or it has a substantially "T" or "L" shaped form. In one aspect according to any one of the preceding aspects the through opening (61*a*) of the outer panel (61) defines a predetermined passage area. In one aspect according to any one of the preceding aspects the ratio between the surface area of the outer panel 61 and the passage area of the through opening 61*a* of the same outer panel is larger than 1.5, optionally larger than 2, still more particularly comprised between 3 and 20.

In one aspect according to any one of the preceding aspects the through opening (62*a*) of the inner panel (62) is delimited by a closed edge. In one aspect according to any one of the preceding aspects the through opening (62*a*) of the inner panel (61) is arranged at a central zone of the inner panel. In one aspect according to any one of the preceding aspects the through opening (62*a*) of the inner panel (62) has a rectangular or circular shape or it has a substantially "T" or "L" shaped form. In one aspect according to any one of the preceding aspects the through opening (62*a*) of the outer panel (62) defines a predetermined passage area. In one aspect according to any one of the preceding aspects the ratio between the surface area of the inner panel 62 and the passage area of the through opening 62*a* of the same inner panel 62 is larger than 1.5, optionally larger than 2, still more particularly comprised between 3 and 20.

In one aspect according to any one of the preceding aspects the outer panel is externally delimited by an outer perimeter edge substantially identical in shape and size to an external perimeter edge delimiting said inner panel.

In one aspect according to any one of the preceding aspects the wall (60) comprises at least one intermediate panel (63) interposed between the outer panel (61) and the inner panel (62). In one aspect according to any one of the preceding aspects the at least one intermediate panel (63) directly faces at least one between the outer panel (61) and the inner panel (62).

In one aspect according to any one of the preceding aspects the intermediate panel is externally delimited by an outer perimeter edge substantially identical in shape and size to an outer perimeter edge delimiting said inner panel and/or said inner panel.

In one aspect according to any one of the preceding aspects the intermediate panel (63) comprises a groove (64) suitable to receive, in engagement, the at least one selector (90). In one aspect according to any one of the preceding aspects the groove (64) of the intermediate panel (63), together with at least one between the inner panel (62) and the outer panel (61), delimit a seat (65) within which the at least one selector (90) is movable.

In one aspect according to any one of the preceding aspects in which:

the at least one intermediate panel (63) is, on one side, directly integrally joined to the outer panel (61) by means of a first connection edge, optionally the intermediate panel (63) is, on an opposite side, directly integrally joined to the inner panel (62) by means of a second connection edge opposite the first connection edge, or the intermediate panel (63) is directly integrally joined only to the inner panel (62) by means of a connection edge, the inner panel (62) is directly integrally joined to the outer panel (61) by means of a respective connection edge opposite the connection edge of the inner panel (62) and of the intermediate panel (63).

In one aspect according to any one of the preceding aspects the outer panel (61), the inner panel (62) and the at least one intermediate panel (63) are joined in a single piece. In one aspect according to any one of the preceding aspects the wall (60) can be made via folding of the at least one intermediate panel (63) in interposition between the outer panel (61) and the inner panel (62).

In one aspect according to any one of the preceding aspects the at least one selector (90) has a surface area larger than a passage area defined by the through opening (61*a*) of the outer panel (61); optionally the passage area of the through opening (61*a*) of the outer panel (61) is measured along the development plane of the outer panel (61) while the surface area of the selector (90) is measured along a development plane of the selector (90).

In one aspect according to any one of the preceding aspects the at least one selector (90) is delimited by an outer perimeter edge which, visible according to a direction perpendicular to the development plane of the selector (90) itself, entirely contains the through opening (61*a*) of the outer panel (61).

In one aspect according to any one of the preceding aspects the at least one selector (90) has a surface area larger than a passage area defined by the through opening (62*a*) of the inner panel (62); optionally said passage area of the through opening (62*a*) of the inner panel (61) is measured along the development plane of the inner panel (62).

In one aspect according to any one of the preceding aspects the selector (90) is delimited by an outer perimeter edge which, visible according to a direction perpendicular to the development plane of the selector (90) itself, entirely contains the through opening (62*a*) of the inner panel.

In one aspect according to any one of the preceding aspects the outer perimeter edge of the selector is of closed type. In one aspect according to any one of the preceding aspects the passage area defined by the through opening (61*a*) of the outer panel is larger than or equal to the passage area defined by the through opening (62*a*) of the inner panel. In one aspect according to any one of the preceding aspects the ratio between the passage area of the through opening (61*a*) of the outer panel (61) and the passage area of the through opening (62*a*) of the inner panel (62) is equal to or larger than 1, optionally is comprised between 1.1 and 10, still more optionally between 1.5 and 7. In one aspect according to any one of the preceding aspects the groove (64) passing through the thickness of the intermediate panel (63).

In a further aspect according to any one of the preceding aspects the at least one selector (90) is at least partly, optionally entirely, contained within the groove (64) of the intermediate panel (63).

In one aspect in accordance with any one of the preceding aspects the intermediate panel (63) is extended along a development plane substantially parallel to at least one of the development planes of the outer and inner panels (61, 62).

In one aspect according to any one of the preceding aspects the groove (64) of the intermediate panel (63) has a passage area larger than the surface area of the at least one selector (90) in a manner such to allow the movement of said selector within the groove (64), optionally between the first and second operative positions. In one aspect according to any one of the preceding aspects the ratio between the passage area of the groove (64) and the surface area of the selector (90) is larger than 1.05, in particular comprised between 1.1 and 7, still more particularly between 1.1 and 5.

In one aspect according to any one of the preceding aspects the through opening (61*a*) of the outer panel has a passage area smaller than a passage area of the groove (64) of the intermediate panel. In one aspect according to any one of the preceding aspects the through opening (62*a*) of the inner panel has a passage area smaller than a passage area of the groove (64) of the intermediate panel. In one aspect according to any one of the preceding aspects the groove (64) of the intermediate panel (63) is delimited by a perimeter edge. In one aspect according to any one of the preceding aspects the selector (90) is at least partly counter-shaped to the perimeter edge of the groove (64) of the intermediate panel.

In one aspect according to any one of the preceding aspects the through opening (91) of the selector, in the first operative position of the latter, is at least partly aligned with the through openings (61*a*, 62*a*) of the outer panel and of the inner panel, optionally along a direction orthogonal to a development plane of at least one from among: the outer panel, the inner panel and the selector.

In one aspect according to any one of the preceding aspects the through opening (91) of the selector has a passage area smaller than a passage area of the through opening (61*a*) of the outer panel. In one aspect according to any one of the preceding aspects the through opening (61*a*) of the outer panel is delimited by a perimeter edge which, visible along a direction perpendicular to the development plane of the outer panel and in the first operative position of the selector, entirely contains the through opening (91) of the selector (90).

In one aspect according to any one of the preceding aspects the through opening (61*a*) of the outer panel is delimited by a perimeter edge which, visible along a direction perpendicular to the development plane of the outer panel, entirely contains the through opening (62*a*) of the inner panel. In one aspect according to any one of the preceding aspects the through opening (91) of the selector is delimited by a respective perimeter edge of closed type which, visible along a direction perpendicular to the development plane of the selector and in the second operative position of the selector, is offset (it does not contain) with respect to the through opening (62*a*) of the inner panel.

In one aspect according to any one of the preceding aspects the at least one intermediate panel (63) comprises a first intermediate panel (63*a*) and at least one second intermediate panel (63*b*) integrally joined by means of a connection edge. In one aspect according to any one of the preceding aspects the first intermediate panel (63*a*) is according to any one of the preceding aspects relative to the intermediate panel (63). In one aspect according to any one of the preceding aspects the second intermediate panel (63*b*) is according to any one of the preceding aspects relative to the intermediate panel (63).

In one aspect according to any one of the preceding aspects the first and the second intermediate panels are extended along respective development planes that are substantially parallel to each other. In one aspect according to any one of the preceding aspects the first intermediate panel directly faces the second intermediate panel.

In one aspect according to any one of the preceding aspects the first intermediate panel (63*a*) comprises a groove (66) passing through the thickness of the first intermediate panel itself. In one aspect according to any one of the preceding aspects the second intermediate panel (63*b*) comprises a respective groove (67) passing through the thickness of the second intermediate panel itself. In one aspect according to any one of the preceding aspects the selector (90) is engaged at least partly within at least one between the grooves (66, 67) of the first and second intermediate panels (63*a*, 63*b*), said selector (90) being movable with respect to the first and second intermediate panels. In one aspect according to any one of the preceding aspects the grooves (66, 67) of the first and second intermediate panel (63*a*, 63*b*)—together with the outer and inner panels—define the seat within which the selector (90) is movable.

In one aspect according to any one of the preceding aspects the groove (66) of the first intermediate panel (63*a*) has a passage area larger than a passage area of each of the through openings (61*a*, 62*a*) of the outer and inner panels (61, 62). In one aspect according to any one of the preceding aspects the groove (67) of the second intermediate panel (63*b*) has a passage area larger than a passage area of each of the through openings (61*a*, 62*a*) of the outer and inner panels (61, 62). In one aspect according to any one of the preceding aspects the groove (66) of the first intermediate panel (63*a*) has a passage area larger than a passage area of the groove (67) of the second intermediate panel (63*b*). In one aspect according to any one of the preceding aspects the at least one selector (90) comprises a first selector (90*a*) and a second selector (90*b*). In one aspect according to any one of the preceding aspects the first selector (90*a*) is according to any one of the preceding aspects relative to the selector (90). In one aspect according to any one of the preceding aspects the second selector (90*b*) is according to any one of the preceding aspects relative to the selector (90). In one aspect according to any one of the preceding aspects the first selector (90*a*) is housed only within the groove (66) of the first intermediate panel (63*a*) and comprises a through opening (92), the first panel (90*a*), said first selector (90*a*) being movable with respect to the first intermediate panel between the first and second operative positions along a trajectory. In one aspect according to any one of the preceding aspects the second selector (90*b*) is housed only within the groove (67) of the second intermediate panel (63*b*) and comprises a through opening (93) the secondo panel, said second selector (90*b*) being movable with respect to the second intermediate panel between the first and second operative positions along a respective trajectory different from the movement trajectory of the first selector (90*a*). In one aspect according to any one of the preceding aspects the first selector (90*a*), when in the first operative position, has the through opening (92) thereof at least partly aligned with the through openings of the outer and inner panels (61, 62). In one aspect according to any one of the preceding aspects the second selector (90*b*), when in the first operative position, has the through opening (93) thereof at least partly aligned with the through openings of the outer and inner panels (61, 62). In one aspect according to any one of the preceding aspects the through openings of the first and second selector (90*a*, 90*b*), when said first and second selector are both in the first operative position, are at least partly aligned with the through openings of the outer and inner panels (61, 62) so as to define essentially with the latter through openings a single passage passing through the wall (60). In one aspect according to any one of the preceding aspects the first and the second intermediate panel (63*a*, 63*b*) are interposed between the outer panel (61) and the inner panel (62). In one aspect according to any one of the preceding aspects the first intermediate panel (63*a*) directly faces the outer panel and it is interposed between said outer panel and the second intermediate panel. In one aspect according to any one of the preceding aspects the second intermediate panel (63*b*) directly faces the inner panel and interposed between said inner panel and the first intermediate panel. In one aspect according to any one of the preceding aspects the outer panel, the inner panel, the first intermediate panel and the second intermediate panel are joined in a single piece. In one aspect according to any one of the preceding aspects the wall (60) can be made via folding of the first and second intermediate panel in interposition between the outer panel (61) and the inner panel (62). In one aspect according to any one of the preceding aspects the at least one selector (90) is extended along a development plane parallel to the development plane of the outer panel (61) and of the inner panel (62). In one aspect according to any one of the preceding aspects the through opening (91) of the selector (90) is delimited by a perimeter edge defining a gripping portion of the selector (90) itself which can be contacted by the user—optionally through the through opening of the outer panel and/or through the through opening of the inner panel—for the movement (optionally manual) of the selector (90) from the first to the second operative position, and vice versa. In one aspect according to any one of the preceding aspects the at least one intermediate panel (63) comprises a first and a second end stop element configured for limiting the movement of the at least one selector (90) between the first and second operative positions.

In one aspect according to any one of the preceding aspects the wall comprises at least one weakening portion configured for defining a locking condition in which the weakening portion itself integrally connects the at least one selector (90) with the at least one intermediate panel (63). In one aspect according to any one of the preceding aspects the weakening portion (69) is configured for being broken following an external stress applied on the selector (90), optionally on the gripping edge of the through opening of the selector, in order to allow the detachment of the selector (90) from the intermediate panel to define a movement condition in which the selector (90) is movable between the first and second operative positions, and vice versa. In one aspect according to any one of the preceding aspects the wall (60) is made of sheet material, optionally paper.

In one aspect according to any one of the preceding aspects the through opening (92) of the first selector (90*a*) has a predetermined passage area larger than a passage area of the through opening (93) of the second selector (90*b*). In one aspect according to any one of the preceding aspects the through opening (92) of the first selector (90*a*) has a predetermined passage area smaller than the passage area of the through opening (61) of the outer panel (61). In a further aspect, a process is provided for making a wall in accordance with any one of the preceding aspects. In one aspect according to the preceding aspect the process comprises the following steps:

preparing at least one first flat sheet (81) comprising at least one through notch (81*a*), preparing at least one second flat sheet (82) comprising at least one through notch (82*a*);

preparing at least one third flat sheet (83) comprising at least one through notch (83*a*), superimposing the first and second flat sheets (81, 82) such that the same are substantially parallel to each other such that they can respectively define the outer panel (61) and the inner panel (62) of the wall (60), positioning the third sheet (83) in interposition between the first and second sheets superimposed such that said third sheet defines said selector (90).

In one aspect according to any one of the preceding aspects the process also comprises a step of constraining the first and second sheets (81, 82), for example by means of gluing. In one aspect according to any one of the preceding aspects the process also comprises a step of preparing at least one fourth sheet (84) comprising at least one through notch (84*a*). In one aspect according to any one of the preceding aspects the first sheet (81), the second sheet (82) and the fourth sheet (84) are integrally joined by means of connection edges and aligned along a predetermined direction, in which the process comprises a step of folding the first sheet (81), the second sheet (82) and the fourth sheet (84) at the connection edges so as to prepare the fourth sheet in interposition between the first and second sheets, in which—following the folding step—the first, second and fourth sheets respectively define the outer panel (61), the inner panel (62) and the intermediate panel (63) of the wall (60).

In one aspect according to any one of the preceding aspects in which, following the superimposition of the first and second sheets (81, 82), the notches of the latter sheets respectively define the through openings (61*a*, 62*a*) of the outer and inner panels of the wall (60). In one aspect according to any one of the preceding aspects the process comprises a step of cutting the fourth sheet to define on the same the through notch (84*a*) suitable to define, following the definition of the intermediate panel (63) interposed between the outer and inner panels, the groove (64) of the intermediate panel (63) and at the same time obtaining the cut of the forth sheet the selector (90).

In one aspect according to any one of the preceding aspects the process in which the first sheet (81), the second sheet (82) and the fourth sheet (84) are integrally joined to define a single flat sheet (80), in which the process comprises a die-cutting step during which the through notches (81*a*, 82*a*, 84*a*) of the first, second and fourth sheets are simultaneously executed with the through notch of the third sheet. In one aspect according to any one of the preceding aspects the die-cutting step defines—at the connection edges of the first, second and fourth sheets—creases for the folding of said sheets.

In one aspect according to any one of the preceding aspects the process comprises, following the die-cutting step, the step of folding said single flat sheet (80) so as to prepare the fourth sheet (84) in interposition between the first and second sheets (81, 82) to define the intermediate panel (63) interposed between the outer panel (61) and the inner panel (62) of the wall (60).

In one aspect according to any one of the preceding aspects in which the preparation of the at least one fourth sheet (84) comprises the preparation of two fourth sheets (84', 84") integrally joined together by means of a connection edge and respectively integrally joined to the first and second sheets (81, 82), said fourth sheets (84', 84") comprising respective through notches (84*a*', 84*a*"), in which the process comprises the positioning of the fourth sheets in interposition between the first and second sheets (81, 82) folded in a manner such that said two fourth sheets can respectively define the first and the second intermediate panel, in which the through notches of the two fourth sheets define the through openings of the first and second intermediate panels.

In one aspect according to any one of the preceding aspects in which the first sheet (81), the second sheet (82) and the two fourth sheets (84', 84") are integrally joined to define the single flat sheet (80), in which the process comprises a die-cutting step during which the through notches (81*a*, 82*a*, 83*a*, 84*a*', 84") of the first, second and two fourth sheets are simultaneously executed with the through notches of two third sheets which are directly obtainable by means of the through notches defined on the two fourth sheets, optionally the die-cutting step defines—at the connection edges of the first, second and two fourth sheets—creases for the folding of said sheets, in which the process, following the die-cutting step, comprises the step of folding said single flat sheet (80) so as to prepare the two fourth sheets in interposition between the first and second sheets (81, 82) to define the first and the second intermediate panel (63*a*, 63) arranged in interposition between the outer panel (61) and the inner panel (62) of the wall (60).

In one aspect, a child-proof package (100) is provided comprising at least one wall in accordance with any one of the preceding aspects. In one aspect according to any one of the preceding aspects the package comprises:

- at least one container (1) defining a compartment (3) for housing at least one product, said container (1) having at least one lateral wall (4) defining an opening (5) delimited by a free edge (6), said opening (5) being configured for allowing the insertion and the removal of the product from the container (1),
- at least one case (102) having at least one lateral wall (104) defining at least one access (105) delimited by a free edge (106) configured for allowing the passage of the container (1), said at least one lateral wall (104) of the case (102) delimiting an internal volume (103) configured for receiving in insertion at least part of the container (1), in which the case (102) and the container (1) are relatively movable with respect to each other at least between:
  - a closed condition in which the case (102) obstructs the opening of the container (1), in which the container (1), in said closed condition, is at least partly arranged in the internal volume (103),
  - an open condition in which the case (102) allows the communication between the compartment (3) and the external environment,
- at least one safety device (11) comprising:
  - at least one first coupling portion (12) carried by the case (102) and at least partly arranged in the internal volume (103),
  - at least one second coupling portion (13) carried by the container (1) and arranged outside the compartment (3), in which the first and second coupling portions (12, 13), at least in said closed condition, are configured for being stably engaged with each other to define a locking condition of the safety device (11) in which said first and second coupling portions (12, 13) prevent the case and the container from passing from the closed condition to the open condition, in which at least part of the at least one lateral wall (104) of the case (102) is defined by the wall (60) in accordance with any one of the preceding aspects.

In one aspect according to any one of the preceding aspects the case comprises a predetermined number of lateral walls, in which the wall defines at least one wall of the predetermined number of lateral walls of the case.

In one aspect according to any one of the preceding aspects the selector (90), when arranged in the first operative position, defines the through passage of the wall (60) suitable to allow, in said closed condition, the access from the external environment to the internal volume (103) of the case. In one aspect according to any one of the preceding aspects the through passage of the wall defining at least one lateral wall of the case is configured for allowing the disengagement of the first and second coupling portions and the consequent passage of the case and the container from the closed condition to the open condition.

In one aspect according to any one of the preceding aspects the selector (90) is stably carried by the case and—during the movement from the first and the second operative position, and vice versa—it is entirely arranged in the internal volume (103) of the case (102).

In one aspect according to any one of the preceding aspects the outer panel (61) of the wall (60) defines at least part of an outer lateral surface of the case (102) while the inner panel (62) of the wall (60) defines at least part of an inner lateral surface of the case, at least partly delimiting the internal volume of said case. In one aspect according to any one of the preceding aspects the through opening (61*a*) of the outer panel (61) is configured for allowing, in the closed condition of the case and container and from outside the package, the intervention on the selector (90) in order to allow the movement thereof from the first to the second operative position, and vice versa.

In one aspect according to any one of the preceding aspects the through opening (62*a*) of the inner panel (62) of the wall (60) is arranged in correspondence of at least one between the first and second coupling portions (12, 13). In one aspect according to any one of the preceding aspects the through openings (61*a*, 91) respectively of the outer panel (61) and of the selector (90), in the first operative position of the selector, are at least partly aligned with the through opening (62*a*) of the inner panel (62) along a direction transverse, optionally perpendicular, to the development plane of the outer panel (61) defining said through opening.

In one aspect according to any one of the preceding aspects the first coupling portion (12) is defined on the inner panel (62) of the wall of the case (102). In one aspect according to any one of the preceding aspects the first coupling portion (12) comprises at least one tab (12*a*) defining an undercut delimited by at least one gripping edge (12*b*) configured for being abutted, in the closed condition of the case and the container, against the second coupling portion (13) of the container in order to define said locking condition. In one aspect according to any one of the preceding aspects the gripping edge (12*b*) of the undercut of the first coupling portion is distinct and distanced from the free edge (106) of the access (105) of the case, optionally entirely arranged in the internal volume (103). In one aspect according to any one of the preceding aspects the gripping edge (12*b*) of the undercut of the first coupling portion (12) has a substantially "V" or "C" shape whose concavity is directed on the opposite side with respect to the free edge (106) of the case (102). In one aspect according to any one of the preceding aspects the undercut of the first coupling portion (12) is defined by a through cut executed on the inner panel (62) of the wall. In one aspect according to any one of the preceding aspects said undercut of the first coupling portion (12) is arranged in proximity to the through opening (62*a*) of the inner panel (62) of the wall (60) of the case (102).

In one aspect according to any one of the preceding aspects the second coupling portion (13) comprises at least one panel (13*a*) engaged with the lateral wall (4) of the container (1) and emerging from said lateral wall (4) according to a direction exiting from the compartment (3). In one aspect according to any one of the preceding aspects the panel (13*a*) of the second coupling portion (13) defines an undercut delimited by at least one gripping edge (13*b*) arranged outside the compartment (3), distinct and distanced from the free edge (6) of the opening (5) of the container itself. In one aspect according to any one of the preceding aspects the undercut defined by the panel (13*a*) of the second coupling portion (13), in the closed condition of the case and the container, is stably engaged with the undercut of the first coupling portion (12) to define said locking condition.

In one aspect according to any one of the preceding aspects the at least one second coupling portion (13), optionally the panel (13*a*), is distinct and distanced from the free edge (6) of the opening (5) of the container (1). In one aspect according to any one of the preceding aspects the at least one coupling portion (13), optionally the panel (13*a*), is arranged at a minimum distance from the free edge (6) of the container (1) equal to or larger than 5 mm, optionally equal to or larger than 7 mm, still more optionally comprised between 7 mm and 30 mm. In one aspect according to any one of the preceding aspects the panel (13*a*) is extended starting from an attachment portion (13*c*) along a longitudinal direction moving away from the free edge (6) of the container (1). In one aspect according to any one of the preceding aspects the attachment portion (13*c*) of the panel (13*a*) is integrally joined to the lateral wall (4) of the container (1) directly carrying said panel (13*a*). In one aspect according to any one of the preceding aspects the attachment portion (13*c*) of the panel (13*a*) is distanced from the free edge (6) of the container (1).

In one aspect according to any one of the preceding aspects the panel (13*a*) of the second coupling portion (13) is extended lengthwise starting from a lateral wall (4) of the container (1) directly carrying said panel (optionally starting from the attachment portion 13*c*) along a predetermined longitudinal direction, in which said panel (13*a*) has a predetermined length equal to or larger than 15 mm, optionally comprised between 15 mm and 100 mm; in which the predetermined length of the panel is measured along said predetermined longitudinal direction.

In one aspect according to any one of the preceding aspects the panel (13*a*) of the second coupling portion (13) is extended lengthwise starting from a lateral wall (4) of the container (1) along a predetermined longitudinal direction, in which the ratio between the distance present between the panel (13*a*) and the free edge (6) of the container (1) and the length of said panel (13*a*) is equal to or smaller than 2, optionally comprised between 0.05 and 1, still more optionally comprised between 0.2 and 1; in which the predetermined length of the panel is measured along said predetermined longitudinal direction.

In one aspect according to any one of the preceding aspects the selector (90), when arranged in the first operative position, defines said through opening configured for allowing intervention from outside the package directly on the panel (13*a*) of the second coupling portion (13) in order to allow, in the closed condition of the case and the container, the disengagement of the latter from the first coupling portion (12) and thus allow the passage of the case and the container from the closed condition to the open condition.

In one aspect, a process is provided for making a package according to any one of the preceding aspects. In one aspect according to any one of the preceding aspects the process comprises:

the process for preparing the wall (60) according to any one of the preceding aspects, preparing a first flat blank (50) made of sheet material, optionally made of paper sheet material, said first blank (50) comprising:

a central sheet (51), a predetermined number of lateral sheets (52) integrally joined to the central sheet (51) and emerging from the latter starting from a perimeter edge, in which the first flat sheet (81) is also integrally joined to the central sheet (51) of the first blank (50), in which the second sheet (82) is opposite the central sheet (51) of the first blank on the opposite side with respect to the first sheet (81), said process also comprising the following steps:

folding the predetermined number of lateral sheets (52), together with the first and second sheet (81, 82) in order to define the at least one lateral wall (104) of the case (102) comprising the first coupling portion (12), positioning the third sheet (83) in interposition between the first and second sheets superimposed such that said third sheet defines said selector (90), preparing a second flat blank (70) made of sheet material, optionally made of paper sheet material, distinct from the first blank (50), said second blank (70) comprising:

a central sheet (71), a predetermined number of lateral sheets (72) integrally joined to the central sheet (71) and emerging from the latter starting from a perimeter edge, folding the predetermined number of lateral sheets (72) in order to define the predetermined number of lateral walls (4) of the container (1), defining, on at least one of said lateral walls (4) of the container, at least the second coupling portion (13) of the safety device (11).

In one aspect according to any one of the preceding aspects the process also comprises a step of defining a further notch (82*b*) on the second sheet (82) which—following the folding of the predetermined number of lateral sheets and of the first and second sheets—defines the undercut of the first coupling portion (12).

In one aspect according to any one of the preceding aspects the first sheet (81), the second sheet (82), the fourth sheet (84) of the single flat sheet suitable to form the wall is integrally joined to the first blank to define with the latter a single flat sheet. In one aspect according to any one of the preceding aspects the single flat sheet, defined by the first blank and by the single sheet (80) suitable to make the wall (60), is obtainable by means of one or more steps of die-cutting a flat precursor sheet, optionally made of paper material. In one aspect according to any one of the preceding aspects in which, during the die-cutting of the flat precursor sheet, it allows making, on the fourth sheet, the third sheet for defining the selector and optionally the creases for the folding of the single flat sheet for obtaining the package. In one aspect according to any one of the preceding aspects in which the single sheet, when folded, defines the wall (60) which in turn defines at least one lateral wall of the case. In one aspect according to any one of the preceding aspects following the folding of the lateral sheets (52) of the first blank and of the single sheet (80), these are maintained folded with respect to the central sheet (51) of the first blank by means of gluing.

In one aspect, a method is provided for closing a package according to any one of the preceding aspects, said closing method comprising the following steps:

positioning the case (102) outside the container (1) such that the latter can be at least partly housed in the internal volume of the case (102), moving the case (102) and the container (1) relatively with respect to each other to define the closed condition and consequently the locking condition of the safety device.

In one aspect, a method is provided for opening a package according to any one of the preceding aspects, said opening method comprising the following steps:

moving, in the locking condition and from outside the package (100), the selector (90) from the second to the first operative position so as to define the through opening on the lateral wall of the case (102), disengaging, by means of intervention on at least one between the first and second coupling portions (12, 13), said first and second coupling portions so as to allow the passage of the case and the container from the closed condition to the open condition.

In a further aspect, a use is provided of the wall (60) for making a wall of a package or container of child-proof type. In one aspect according to any one of the preceding aspects wherein the package is obtained by:

a container for containing products, and an outer case suitable to close the container, in which the wall (60) defines at least one wall of the container and/or of the case.

In one aspect according to any one of the preceding aspects in which the container is of the type comprising a storage for containing products and a closure system engaged with the storage and configured for closing the storage, in which the wall defines at least one lateral wall of the storage of the container.

BRIEF DESCRIPTION OF THE DRAWINGS

Several embodiments and several aspects of the finding will be described hereinbelow with reference to the enclosed drawings, provided only as a non-limiting example in which:

FIG. 1 illustrates a sheet for making a wall according to the present invention;

FIGS. 2 and 3 illustrate respectively a blank for making a container and a case of a package according to the present invention;

FIGS. 6 and 7 are detailed section views of a package according to the present invention arranged in a closed condition;

FIGS. 8 and 9 are perspective views of a case, of a package in according to the present invention, illustrated in two different operating conditions;

FIGS. 12 and 13 illustrate steps of folding a further sheet for making a wall according to the present invention;

FIGS. 19 and 20 illustrates a case obtainable by means of the blank of FIG. 18;

DEFINITIONS AND CONVENTIONS

Figure 3:
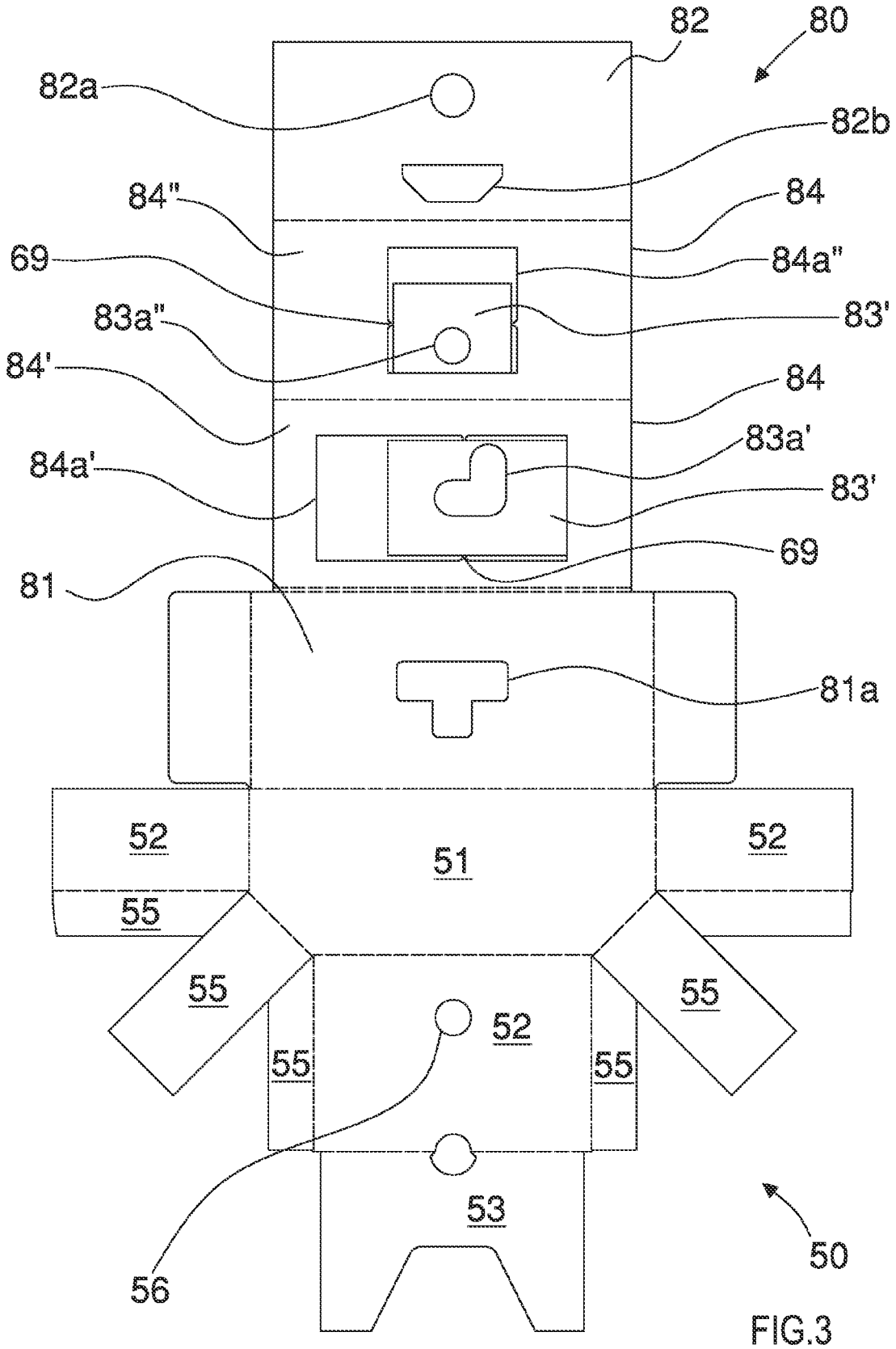

It is observed that in the present detailed description, corresponding parts illustrated in the various figures are indicated with the same numeric references. The figures could illustrate the object of the invention by means of representations that are not in scale; therefore, parts and components illustrated in the figures relative to the object of the invention might only regard schematic representations.

With the term "product" it is intended an article or a compound of articles of any kind. The product can also be a blister carrying a plurality of articles. The product can also comprise: drugs, cosmetic products, capsules for dishwashers and washing machines, cleaning products for the home and for linens/sheets (e.g. detergents), foods and cigarettes.

With the term "paper material" it is intended paper or cardboard, e.g. having at least 50% by weight, optionally at least 70% by weight, of organic material comprising one or more from among cellulose, hemicellulose, lignin, lignin derivatives. The paper material can be made of sheet material having a basis weight comprised between 100 and 500 $g/m^2$. The paper sheet material can be covered at least partly by means of a coating made of plastic material, e.g. a film, whose object is that of: reinforcing the paper sheet material, defining a water and/or moisture barrier. The coating can have a thickness variable between 10 and 50 μm and can be made with one or more of the following materials: LDPE, HDPE, PP, PE.

The term "blank" refers to a flat semifinished product made of sheet material, for example made of paper sheet material, foldable on itself in order to make the package. The blank can be made of a single piece and obtainable by means of die-cutting a single sheet.

With the term "sheet material" it is intended a material that has two dimensions, for example the length and the width, considerably larger than a third dimension, such as the thickness.

With the term "panel" it is intended a laminar body having a substantially constant thickness which can be constituted by a single panel (single-layer) of sheet material or by a multilayer panel defined by a plurality of single-layer sheets coupled together in thickness.

With the term "opening device" it is intended any one tool usable by a user for opening the package. For example, the opening device can comprise at least one selected from the group between: a body made of sheet material (e.g. a payment card, a loyalty card or a suitable key), an elongated body (e.g. a pen or a suitable key).

With the term "manually intervening" or "manual intervention" referred to the user, it is intended a manual action performed by the user without the aid of tools, such as an opening device.

DETAILED DESCRIPTION

Wall 60

Reference number 60 overall indicates a wall employable for making packages or containers, for example of child-proof type, for containing products of various type.

As is visible from FIGS. 4, 8, 9, 15, 17, 20 and 21, the wall 60 comprises an outer panel 61 made of sheet material extended along a main development plane and having a rectangular form. It is however possible to make an outer panel 61 having a different form, e.g. square, elliptical, semi-circular, triangular or trapezoidal.

As is visible from the enclosed figures, the outer panel 61 comprises at least one through opening 61*a* which is extended through the entire thickness of the outer panel 61. The through opening 61*a* is delimited by a perimeter edge which delimits a passage area of the through opening 61*a*. In detail, the perimeter edge of the through opening 61*a* of the outer panel is of closed type and is entirely contained within an outer perimeter edge delimiting the outer panel 61. For example, the ratio between the surface area (extension) of the outer panel 61 and the passage area of the through opening 61*a* is larger than 1.5, optionally larger than 2, still more optionally comprised between 3 and 20.

Figure 4:
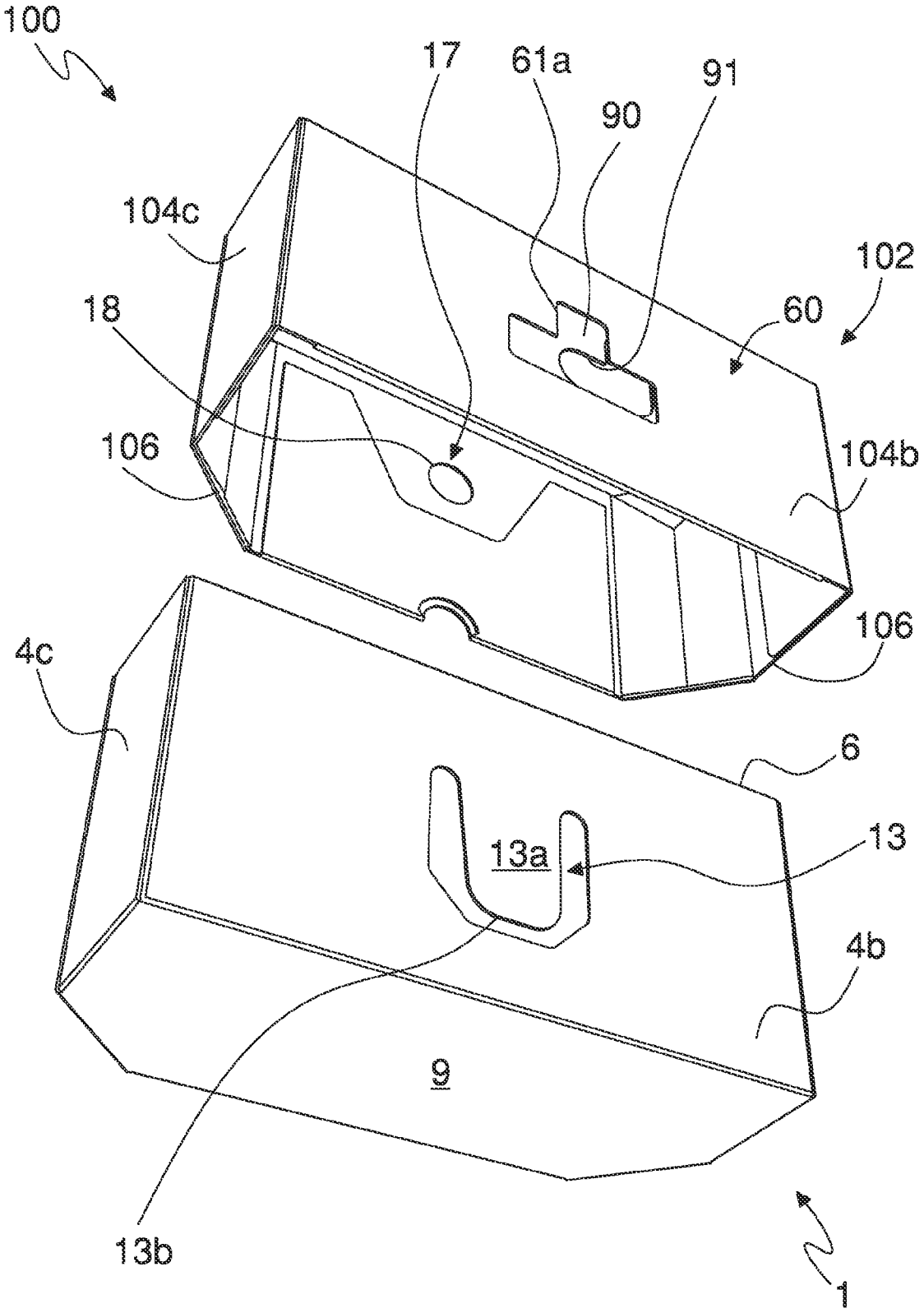
FIGS. 4 and 5 are perspective views of a package according to the present invention arranged in an open condition.
Figure 15:
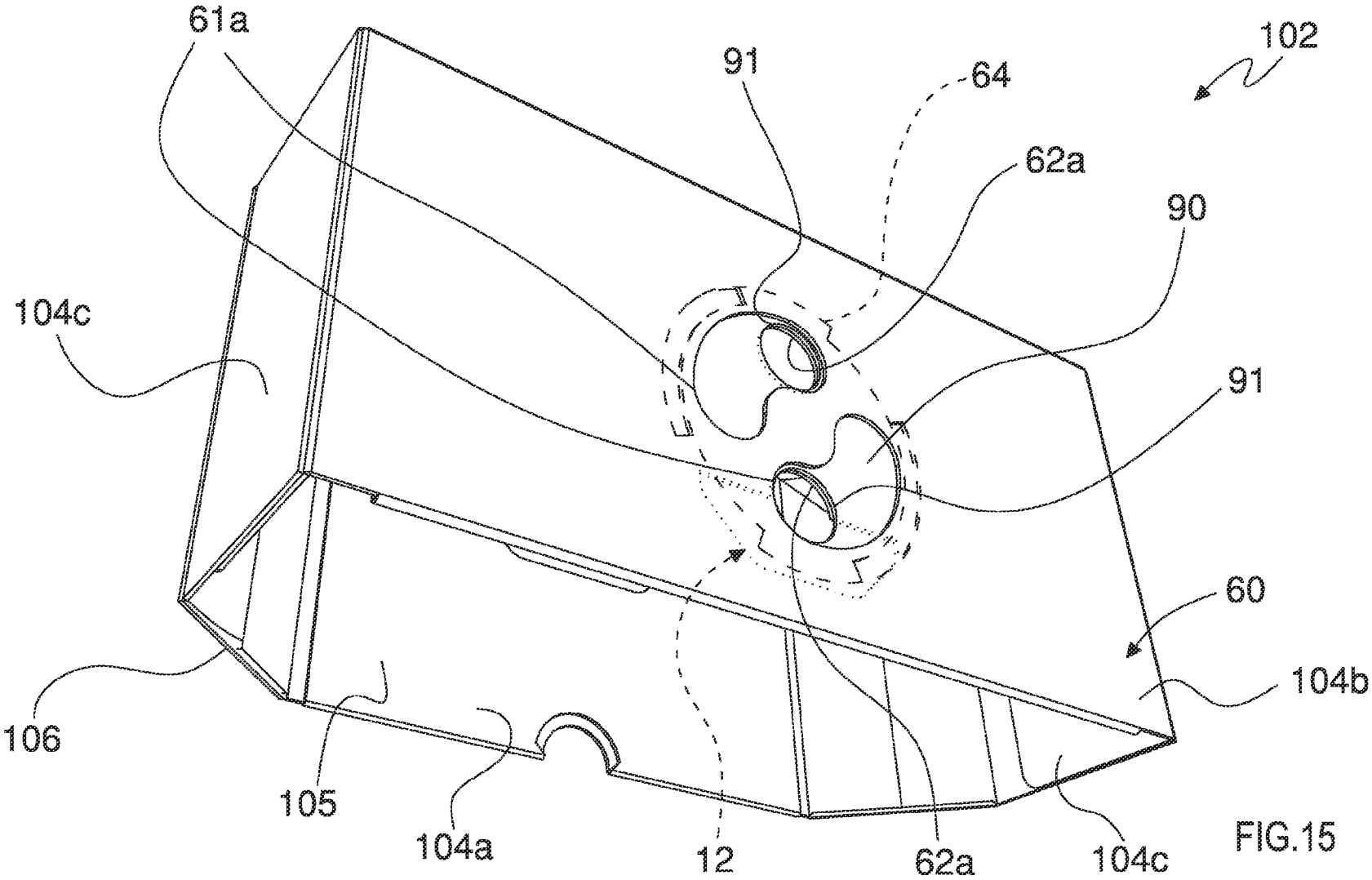
FIG. 15 illustrates a case obtainable by means of the blank of FIG. 14.
Figure 16:
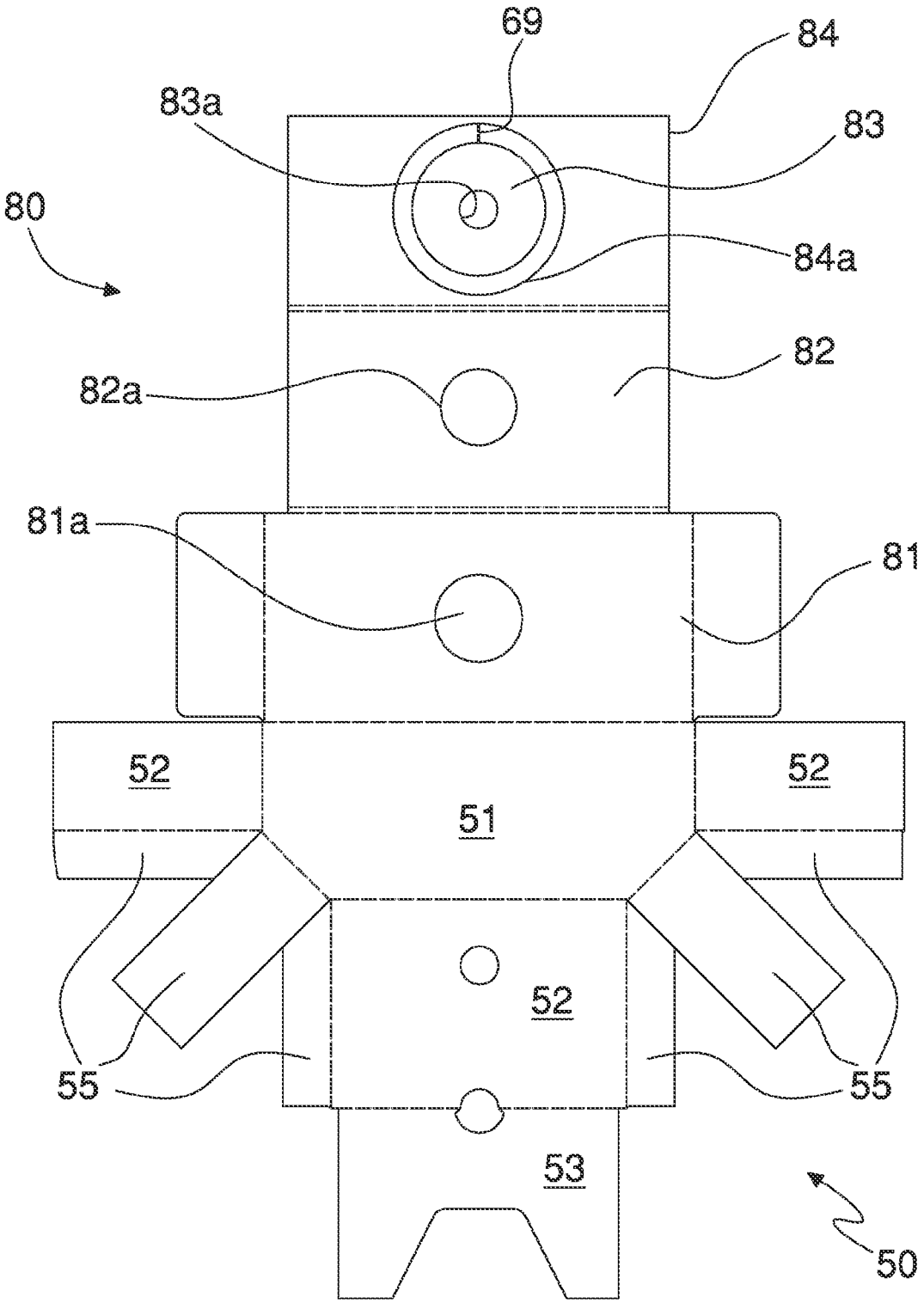
FIG. 16 shows a further blank for making a case of a package.
Figure 17:
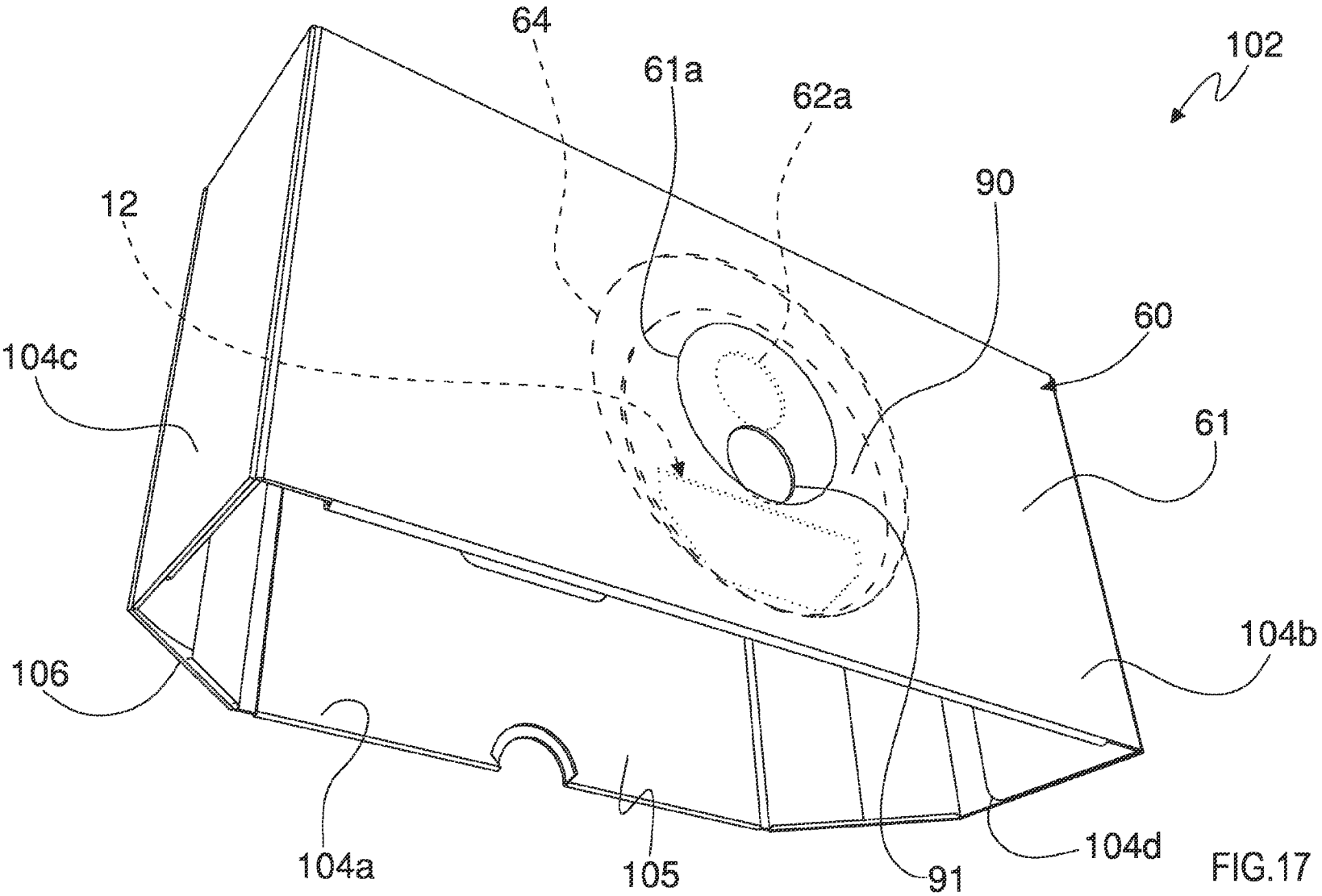
FIG. 17 illustrates a case obtainable by means of the blank of FIG. 16.
Figure 18:
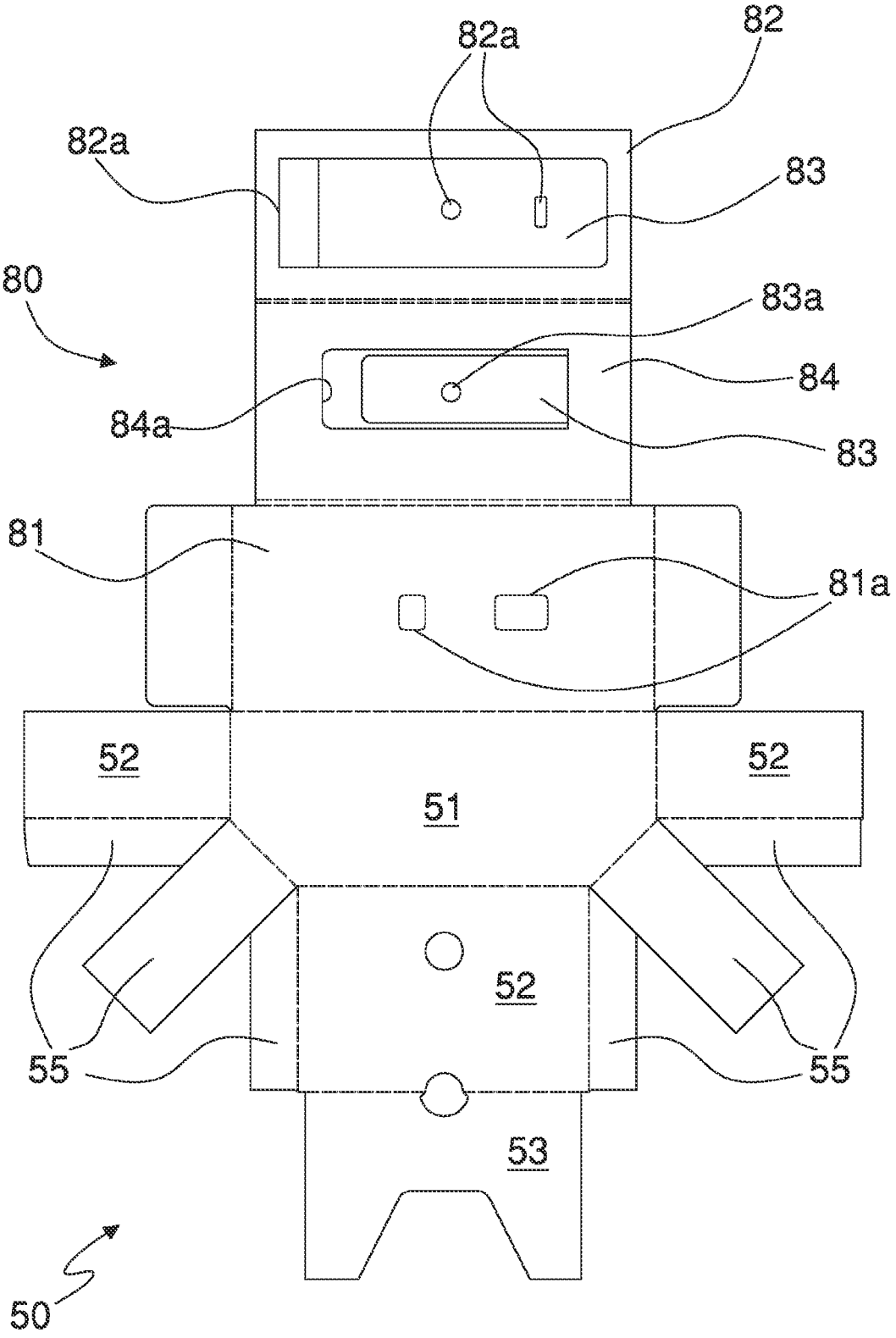
FIG. 18 shows a further blank for making a case of a package.
Figure 21:
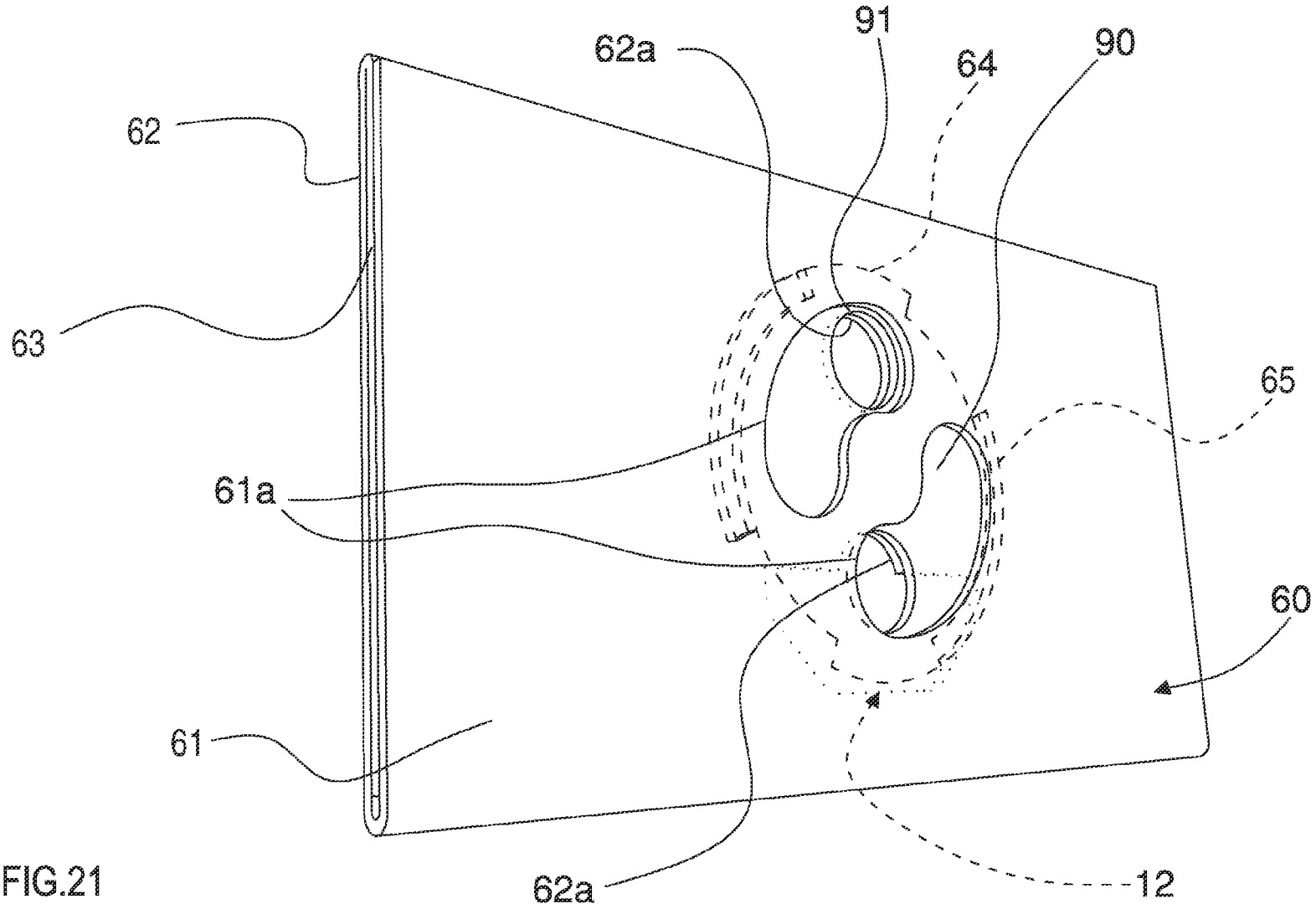
FIG. 21 is a perspective view of a wall according to the present invention.

In FIGS. 4, 8 and 9, a through opening 61*a* was illustrated having a substantially "T" shape substantially positioned at a central zone of the outer panel 61. In FIG. 15, an outer panel 61 is illustrated having two through openings 61*a* with closed profile, each of which extended along a trajectory extended essentially as a circular arc. In FIG. 17, a through opening 61*a* is illustrated, having circular shape. It is possible however to make a through opening 61*a* of the outer panel 61 having a different form, e.g. rectangular, square, elliptical or extended along one or more trajectories. As is visible for example from FIGS. 5, 19 and 21, the wall 60 also comprises an inner panel 62 made of sheet material which is extended along a main development plane and having a rectangular form. It is however possible to make an inner panel 62 having a different form, e.g. square, elliptical, semicircular, triangular or trapezoidal; in detail, the outer panel 61 and the inner panel 62 have the same shape and optionally the same size. For example, the outer and inner panels can have a surface area, measured along the development plane of the same panel, larger than 8 $cm^2$, optionally equal to or larger than 20 $cm^2$, still more optionally comprised between 20 and 500 $cm^2$; in detail, the outer and inner panels can have a length equal to or larger than 5 cm, optionally comprised between 8 and 40 cm, and a width equal to or larger than 5 cm, optionally comprised between 8 and 40 cm.

As is visible from the enclosed figures, the outer panel 61 and the inner panel 62 are engaged with each other and are extended parallel to each other: the main development planes of the panels 61 and 62 are parallel to each other. As is visible for example from FIGS. 5 and 19, the inner panel 62 comprises at least one respective through opening 62*a* which is extended through the entire thickness of the inner panel 62. The through opening 62*a* is delimited by a perimeter edge which delimits a passage area of the through opening 62*a*. In detail, the perimeter edge of the through opening 62*a* of the inner panel 62 is of closed type and is entirely contained within an outer perimeter edge delimiting the inner panel 62. For example, the ratio between surface area (extension) of the inner panel 62 and the passage area of the through opening 62*a* is larger than 1.5, optionally larger than 2 still more optionally comprised between 3 and 20.

Figure 5:
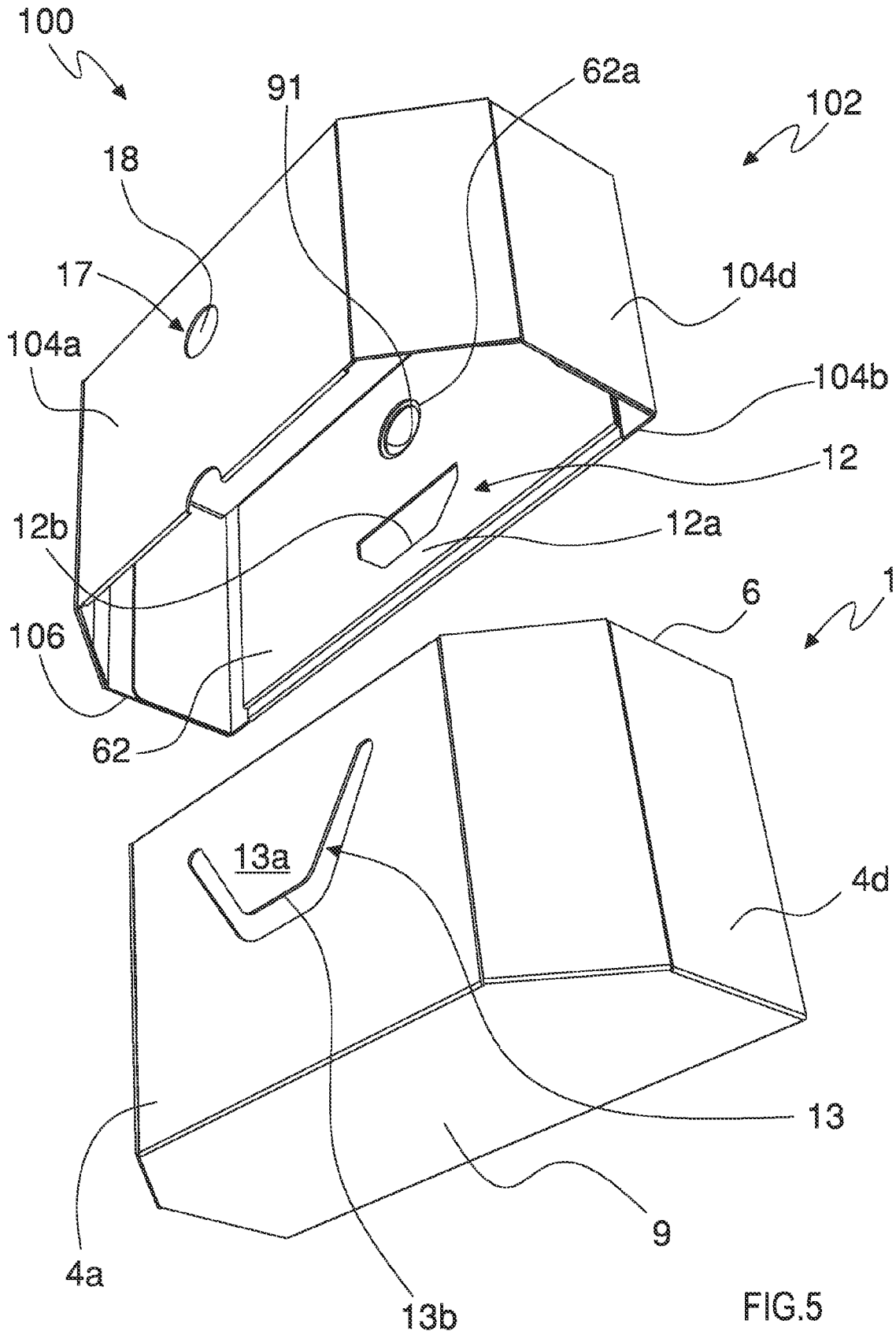

In FIG. 5, a through opening 62*a* is illustrated having a circular shape positioned substantially at a central zone of the inner panel 62. In FIG. 19, a through opening 62*a* is instead illustrated, having a rectangular shape. It is however possible to make a through opening 62*a* of the inner panel 62 having a different form, e.g. square, elliptical or extended along one or more trajectories.

As schematized in FIGS. 6-9, 15, 17 and 20, the through openings 61*a*, 62*a* of the outer and inner panels are aligned along a direction orthogonal to the development plane of the outer panel (optionally of the outer panel and of the inner panel since they are parallel to each other). With regard to size, the through openings 61*a*, 62*a* of the outer and inner panels can have the same size, i.e. substantially define the same passage area or, as illustrated in the enclosed figures, they can have different shape and size. In detail, the passage area of the through opening 61*a* of the outer panel 61 is larger than the passage area of the through opening 62*a* of the inner panel 62. In still more detail, the ratio between the passage area of the through opening 61*a* of the outer panel 61 and the passage area of the through opening 62*a* of the inner panel 62 is equal to or larger than 1, optionally comprised between 1.1 and 10. It is however possible to make a through opening 62*a* of the inner panel 62 having a passage area larger than the passage area of the through opening 61*a* of the outer panel 61 as is for example illustrated in FIG. 20.

As is visible from the enclosed figures, the wall also comprises a selector 90, also made of sheet material, engaged in interposition between the outer panel 61 and the inner panel 62, which is extended along a main development plane; in detail, also the selector 90 is extended along a main development plane parallel to the outer and inner panels: the main development plane of the selector is parallel to at least one between the main development plane of the outer panel 61 and the main development plane of the inner panel 62.

As is visible from the enclosed figures, the selector 90 is larger than the through openings 61*a*, 62*a* of the outer and inner panels in a manner such that said panel can engage said selector without the same being able to exit outward from one of the through openings of the outer and inner panels. In detail, the selector 90 has an (outer) surface area larger than the passage area of the through openings 61*a*, 62*a* of the outer and inner panels; said surface area being measured along the development plane of the selector 90. In still more detail, selector 90 is perimetrically delimited by a closed outer edge which, visible along a direction orthogonal to the development plane of the selector 90, at least partly contains the through opening 61*a* of the outer panel 61 and the through opening 62*a* of the inner panel 62. As is visible from the enclosed figures, also the selector 90 is provided with at least one through opening 91 which is extended through the entire thickness of the selector 90. The through opening 91 is delimited by a perimeter edge which delimits a passage area of the through opening 91 of the selector. In detail, the perimeter edge of the through opening 91 of the selector is of closed type and is entirely contained within an outer perimeter edge delimiting the selector 90. For example, the ratio between surface area (extension) of the separator 90 and the passage area of the through opening 91 of the same separator is larger than 1.5, optionally comprised between 2 and 10.

As is visible for example in FIGS. 5, 8, 9, 16 and 17, the through opening 91 of the selector 90 can have a circular shape, e.g. substantially equal (at least regarding shape) to the through opening 62*a* of the inner panel 62. The through opening 91 of the selector can nevertheless have a different shape, e.g. square, elliptical or extended along one or more trajectories. As specified above, the through opening 91 of the selector 90 defines a predetermined passage area which can be substantially identical to the passage area of the through opening 62*a* of the inner panel 62; It is however possible to make a passage opening 91 of the selector whose passage area is smaller or larger than the passage area of the through opening of the inner panel 62. The through opening 61*a* of the outer panel 61 instead has a passage area larger than the passage area defined by the through opening 91 of the selector 90; in detail, the ratio between the passage area of the through opening 61*a* of the outer panel 61 and the passage area defined by the through opening 91 of the selector 90 is larger than 1.1, optionally comprised between 1.2 and 8. The selector 90 is configured for being moved relative to at least between the outer panel and the inner panel at least between:

- a first operative position in which the through opening 91 of the selector 90 is at least partly facing the through openings 61*a*, 62*a* of the outer and inner panels 61, 62 so as to define with the latter through openings (openings 61*a*, 62*a*) a single passage passing through the wall 60,
- a second operative position in which the through opening 91 of the selector 90 is distanced with respect to at least one of said through openings of the outer and inner panels (61, 62).

In detail, the through opening 91 of the selector 90, in the first operative position of the latter, is at least partly aligned with the through openings 61*a*, 62*a* of the outer panel 61 and of the inner panel 62 along a direction orthogonal to the development plane of at least one from among: the outer panel 61, the inner panel 62 and the selector 90. The single through opening is thus essentially defined by a series of at least partly aligned holes which essentially define a channel passing through the inner thickness of the wall 60. Vice versa, in the second operative position, the through opening 91 of the selector 90 is offset (not facing) at least one of the through openings of the outer and inner panels in a manner such that the same selector 90 can prevent the communication between the through openings 61*a*, 62*a* of the outer and inner panels.

As mentioned above, the selector 90 is extended parallel to the outer panel and to the inner panel; the selector 90 is movable between the first and second operative positions along at least one trajectory lying on a plane substantially parallel to the development planes of the outer panel 61 and/or of the inner panel 62. The movement trajectory can be of rectilinear type (like for the wall illustrated in FIGS. 4, 8, 9, 18-20) or circular type (like for the wall illustrated in FIGS. 15 and 17).

The movement of the selector 90 can be carried out by a user by means of manual intervention and in particular by means of the thrust of the same through the through opening 91 of the selector 90. In particular, the through opening 91 of the selector 90 is delimited by a perimeter edge, optionally closed, defining a gripping portion of the selector 90 itself which can be contacted by the user—through the through opening 61*a* of the outer panel and/or through the through opening 62*a* of the inner panel—for the manual movement of the selector 90 from the first to the second operative position, and vice versa.

The wall 60 can comprise a first and a second selector 90*a*, 90*b*. The first and second selectors are in accordance with the at least one above-described selector 90. The first and second selectors are made of sheet material and engaged in interposition between the outer panel 61 and the inner panel 62; each of said first and second selectors is extended along a main development plane parallel to the outer panel and to the inner panel. In detail, the first and the second selector 90 are parallel to each other and parallel to the outer and inner panels. In still more detail, the first and the second selector are facing, at least partly in contact with each other; the first selector 90*a* is directly interposed between the outer panel 61 and the second selector 90*b* while the second selector 90*b* is directly interposed between the inner panel and the first selector 91.

The first and the second selector 90*a*, 90*b* are larger than the through openings 61*a*, 62*a* of the outer panel 61 and inner panel 62 in a manner such that said panels can engage the selectors without the same can exit outward from one of the through openings of the outer and inner panels. In detail, the first and the second selector 90*a*, 90*b* both have a surface area (extension) larger than the passage area of the through openings 61*a*, 62*a* of the outer and inner panels; said surface area being measured along the development plane of the respective selector. In still more detail, the first and the second selector 90*a*, 90*b* are perimetrically delimited by respective closed outer edges which, visible along a direction orthogonal to the development plane of the respective selector, at least partly contains the through opening 61*a* of the outer panel 61 and the through opening 62*a* of the inner panel 62.

As is visible from the enclosed figures, the first and the second selector 90*a*, 90*b* are provided with respective through openings 92, 93 which are extended through the entire thickness of the respective selector. Each through opening 92, 93 is delimited by a perimeter edge which delimits a passage area. In detail, the perimeter edge of the through opening 92 of the first selector 90*a* is of closed type and is entirely contained within an outer perimeter edge delimiting the first selector 90*a*. For example, the ratio between surface area (extension) of the first selector 90*a* and the passage area of the through opening 92 of the same first selector is larger than 1.5, optionally comprised between 2 and 10. In detail, the perimeter edge of the through opening 93 of the second selector 90*b* is of closed type and is entirely contained within an outer perimeter edge delimiting the second selector 90*b*. For example, the ratio between surface area (extension) of the second selector 90*b* and the passage area of the through opening 93 of the same second selector 90*b* is larger than 1.5, optionally comprised between 2 and 10.

As is visible from the enclosed figures, the through openings 92, 93 of the first and second selector can have a circular shape, for example substantially equal (at least regarding shape) to the through opening of the inner panel and/or of the outer panel. The through openings 92, 93 of the first and second selectors can alternatively have a different form, for example square, elliptical or extended along one or more trajectories. The through openings 92, 93 of the first and second selector can be different regarding shape and/or size. In detail, the through opening 92 of the first selector 90*a* defines a predetermined passage area larger than a passage area defined by the through opening 93 of the second selector 90*b*. Nevertheless, the passage area of the through opening 92 of the first selector is smaller than the passage area of the through opening 61*a* of the outer panel 61. The passage area of the through opening 62*a* of the inner panel can be larger and/or smaller than the passage area of the through openings of the first and second selector.

As for the above-described selector 90, the first and second selectors are relatively movable with respect to each other and relative to at least between the outer panel and the inner panel at least between the respective first and second operative positions. In the first operative position of the first selector, the latter has its through opening 92 at least partly facing the through openings 61*a*, 62*a* of the outer and inner panels 61, 62; in the same manner, in the first operative position of the second selector, the latter has its through opening 93 at least partly facing the through openings 61*a*, 62*a* of the outer and inner panels 61, 62. In the second operative position, both the selectors 90*a*, 90*b* have the through openings distanced with respect to at least one of said through openings of the outer and inner panels 61, 62.

In fact, when both the selectors (first and second) are in the respective first position, the through openings 92, 93 are at least partly aligned with the through openings 61*a*, 62*a* of the outer panel 61 and of the inner panel 62 along a direction orthogonal to the development plane of at least one between: the outer panel 61 and the inner panel 62 define a single passage passing through the wall 60, adapted to place in communication the through openings 61*a*, 62*a* of the outer and inner panels. The single through opening is essentially defined therefore by a series of at least partly aligned holes which essentially define a channel passing through the inner thickness of the wall 60.

Vice versa, when at least one between the first and second selectors is in the second operative position, at least one between said through openings 92 and 93 is offset (not facing) at least one of the through openings of the outer and inner panels in a manner such that the selector (first and/or second) can prevent the communication between the through openings 61*a*, 62*a* of the outer and inner panels.

As mentioned above, the first and the second selector 90*a*, 90*b* are extended parallel to each other and parallel to the outer panel and to the inner panel. In detail, the first and the second selector 90*a*, 90*b* are superimposed on each other and movable between the first and second operative positions along respective and different trajectories lying on a plane substantially parallel to the development planes of the outer panel 61 and/or of the inner panel 62. Such movement trajectories of the first and second selector 90*a*, 90*b* can be of rectilinear or circular type.

The movement of the first and second selector 90*a*, 90*b* can be carried out by a user by means of manual intervention and in particular by means of the thrust of the same through the through opening 92, 93 of the respective selector 90. In particular, the through openings of the first and second selectors are delimited by respective perimeter edges, optionally closed, defining respective gripping portions of the first and second selectors which can be contacted by the user—through the through opening 61*a* of the outer panel 61 and/or through the through opening 62*a* of the inner panel 62—for the manual movement of the first and second selector 90*a*, 90*b* from the first to the second operative position, and vice versa.

As described above, the through opening 61*a* of the outer panel 61 has a passage area larger than the passage area of the through opening 92 of the first selector 90*a*; in addition, the through opening 92 of the first selector has a passage area larger than the passage area of the through opening 93 of the second selector 90*a*. Due to the size variation of the through openings of the outer panel and of the first and second selector, the user can, through the outer panel 61, act both on the first and on the second selector for the movement of the latter between the first and second operative positions.

As described above, the at least one selector 90 (optionally the first and the second selector 90*a*, 90*b*) can be engaged directly between the outer panel 61 and the inner panel 62 without there being a further support element, i.e. in a manner such that the at least one selector is engaged within a seat defined directly and exclusively by the outer panel 61 and by the inner panel 62. Alternatively, the at least one selector 90 (optionally the first and second selectors 90*a*, 90*b*) can also be carried by at least one intermediate panel 63 as illustrated in the enclosed figures. In the following description, a first embodiment is described in which the wall comprises a single intermediate panel 63 and a single selector 90 and a second embodiment of the wall 60 comprising a first and second intermediate panels 63*a*, 63*b* carrying the first and second selectors 90*a*, 90*b*

In detail, in the first embodiment, the wall 60 comprises an intermediate panel 63 made of sheet material, extended along a main development plane, parallel to the outer panel 61 and inner panel 62: the main development planes of the outer, inner and intermediate panels are parallel to each other. The intermediate panel 63 is interposed between the outer panel 61 and the inner panel 62: the intermediate panel 63 on one side faces the outer panel and on the opposite side faces the inner panel 62.

Figure 10:
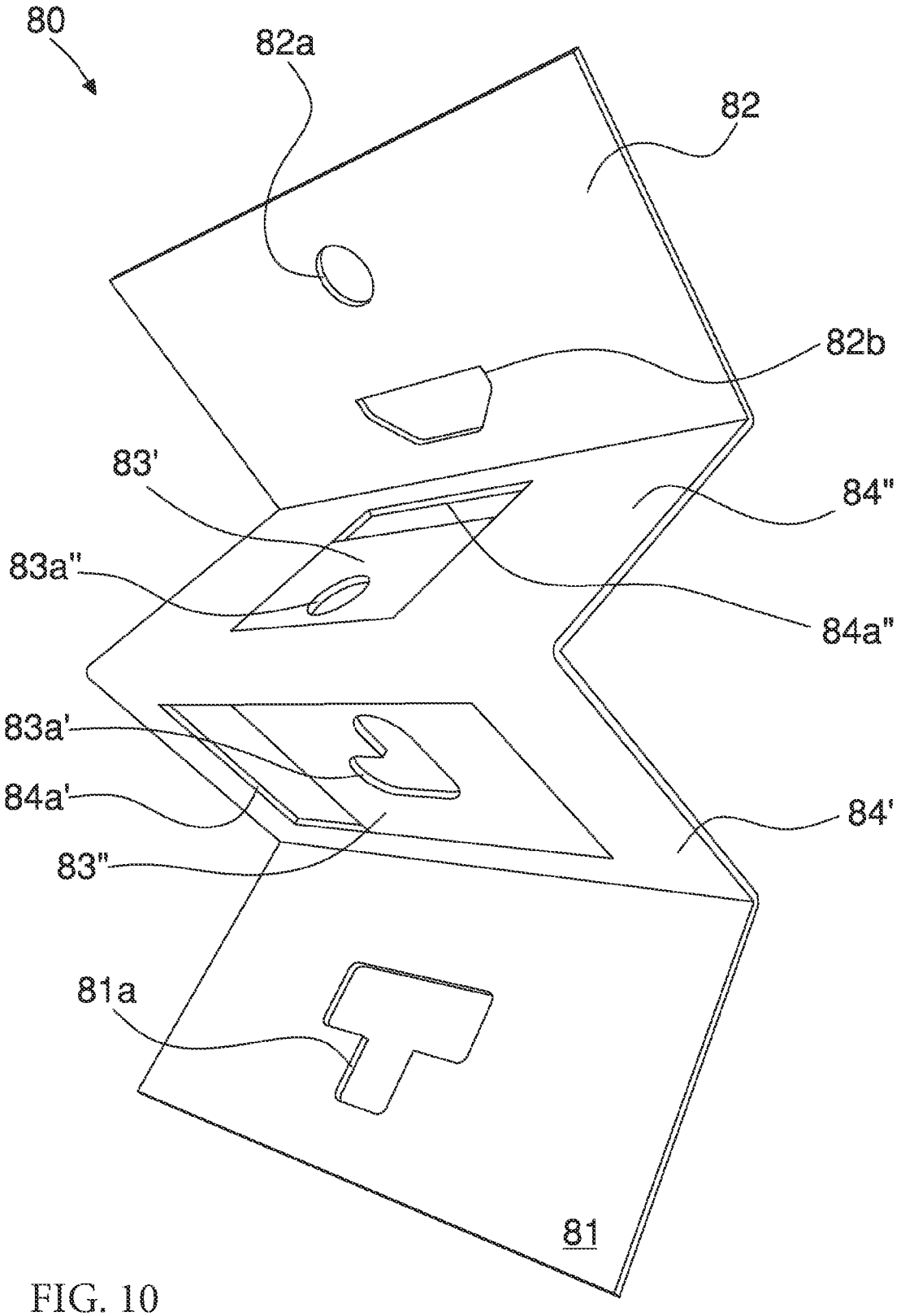
FIG. 10 is a schematic view of a step of folding a sheet for making a wall according to the present invention.

The intermediate panel 63 can have a rectangular form. It is however possible to make an intermediate panel 63 having a different form, e.g. square, elliptical, semicircular, triangular or trapezoidal; in detail, the intermediate panel 63 has a shape, and optionally a size, substantially identical to the shape (and optionally the size) of the outer panel 61 and/or of the inner panel 62. In detail, the intermediate panel can have a surface area larger than 8 $cm^2$, optionally comprised between 20 and 500 $cm^2$; the intermediate panel can further have a length equal to or larger than 5 cm, optionally comprised between 8 and 40 cm, and a width equal to or larger than 5 cm, optionally comprised between 8 and 40 cm. The intermediate panel 63 can be on one side directly integrally joined to the outer panel 61 by means of a first connection edge and on the opposite side directly integrally joined to the inner panel 62 by means of a second connection edge opposite the first connection edge. Alternatively, the intermediate panel 63 can be directly integrally joined only to the inner panel 62 by means of a connection edge: the inner panel 62 is in turn directly integrally joined to the outer panel 61 by means of a respective connection edge opposite the connection edge of the inner panel 62 and of the intermediate panel 63. In both of the above-described configurations, the outer panel 61, the inner panel 62 and the intermediate panel 63 are joined in a single piece to form a single body; as will be better described hereinbelow and as schematically illustrated in FIGS. 10, 12 and 13, the wall 60 is made via folding of the intermediate panel 63 in interposition between the outer panel 61 and the inner panel 62.

As is visible in the enclosed figures, the intermediate panel 63 comprises at least one groove 64 adapted to receive the selector 90; in fact, the groove 64 of the intermediate panel 63, together with the inner panel 62 and the outer panel 61, delimit a seat 65 within which the selector 90 is movable; the groove 64 passes through the thickness of the intermediate panel 63 and the selector 90 is entirely contained within said groove 64. In particular, the groove 64 is delimited by a perimeter edge with closed profile which, visible along a direction orthogonal to the main development plane of the intermediate panel 63, entirely contains the selector 90. The groove can have a substantially rectangular form (see for example FIGS. 8, 9 and 20) or substantially circular (see for example FIGS. 15 and 17); it is however possible to make a groove 64 having a different form, e.g. square, elliptical, trapezoidal. The selector 90 is at least partially counter-shaped with respect to the perimeter edge of the groove 64 of the intermediate panel 63: this configuration allows the groove to guide the movement of the selector 90 between the first and second operative positions. The intermediate panel 63 can also comprise at least one first and one second end stop element configured for limiting the movement of the selector 90 between the first and second operative positions; such end stop elements can alternatively be carried by the outer panel and/or by the inner panel.

In order to internally house the selector 90, the groove 64 has a passage area larger than the surface area of the selector 90 in a manner such to allow the movement of the selector itself within the groove 64 between the first and second operative positions. In particular, the ratio between the passage area of the groove 64 and the surface area of the selector 90 is larger than 1.05, in particular comprised between 1.1 and 7, still more particularly between 1.1 and 5; the surface area of the selector 90 and the passage area of the groove 64 are measured in the main development plane of the intermediate panel 63 carrying said selector 90. In particular, the groove 64 is delimited by a perimeter edge with closed profile which, visible along a direction orthogonal to the main development plane of the intermediate panel 63, entirely contains the selector 90.

As described above, the selector 90 has a surface area larger than the passage area of the through openings 61*a*, 62*a* of the outer panel 61 and of the inner panel 62; in particular, the outer perimeter edge which defines the surface area of the selector 90, in the first and in the second operative position of the selector 90 itself (such as also in the intermediate operative positions defined between said first and second operative positions), is configured for containing within its own profile—visible along a direction orthogonal to the development plane of the selector 90—said through openings 61*a*, 62*a* of the outer and inner panels.

The ratio between the passage area of the groove 64 and the passage area of the through opening 61*a* of the outer panel 61 is larger than 2, optionally equal to or larger than 3, still more optionally comprised between 3 and 15. In the same manner, the ratio between the passage area of the groove 64 and the passage area of the through opening 62*a* of the inner panel 62 is larger than 2, optionally equal to or larger than 3, still more optionally comprised between 3 and 15.

Figure 11:
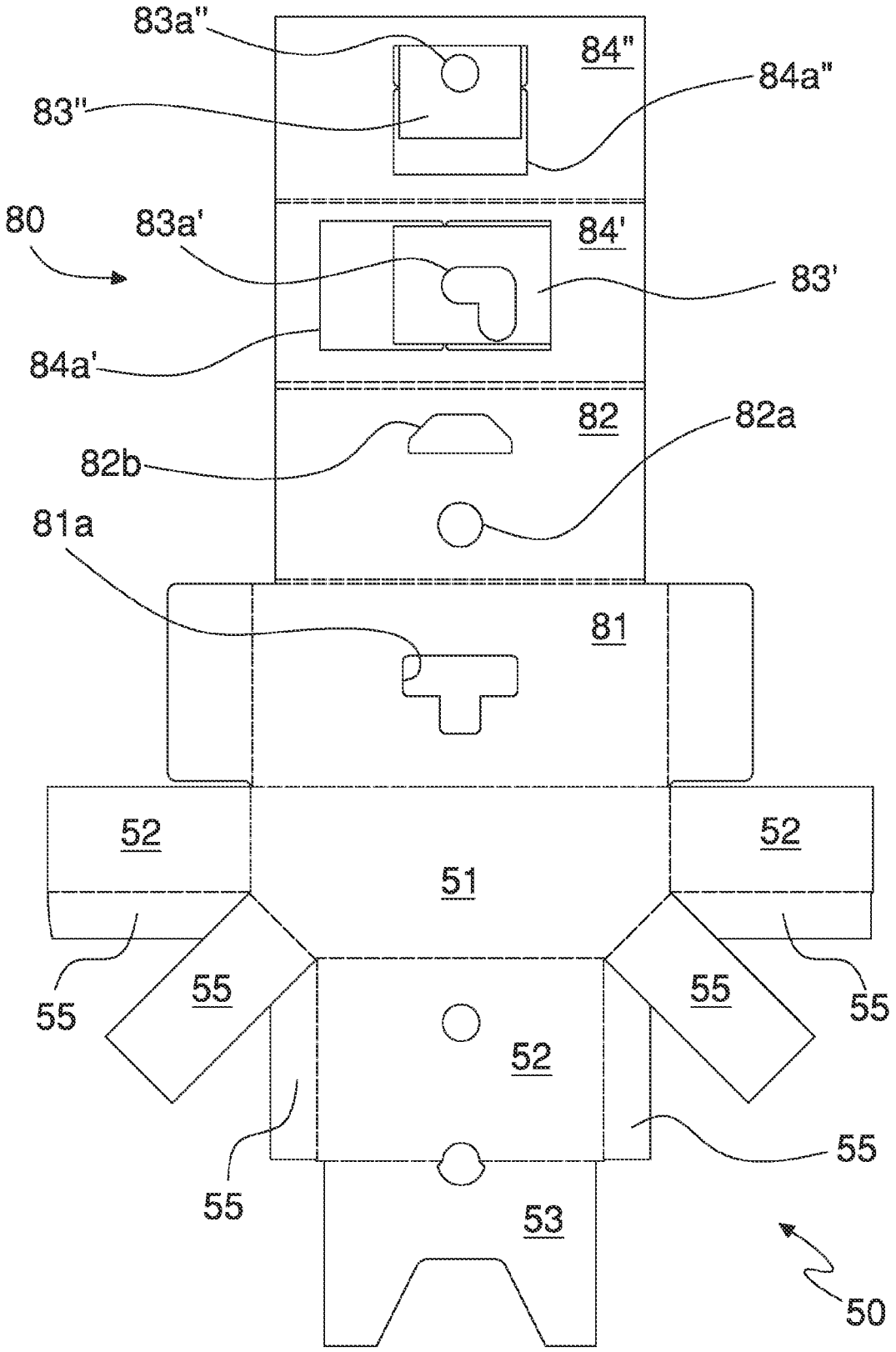
FIG. 11 shows a further blank for making a case of a package according to the present invention.
Figure 14:
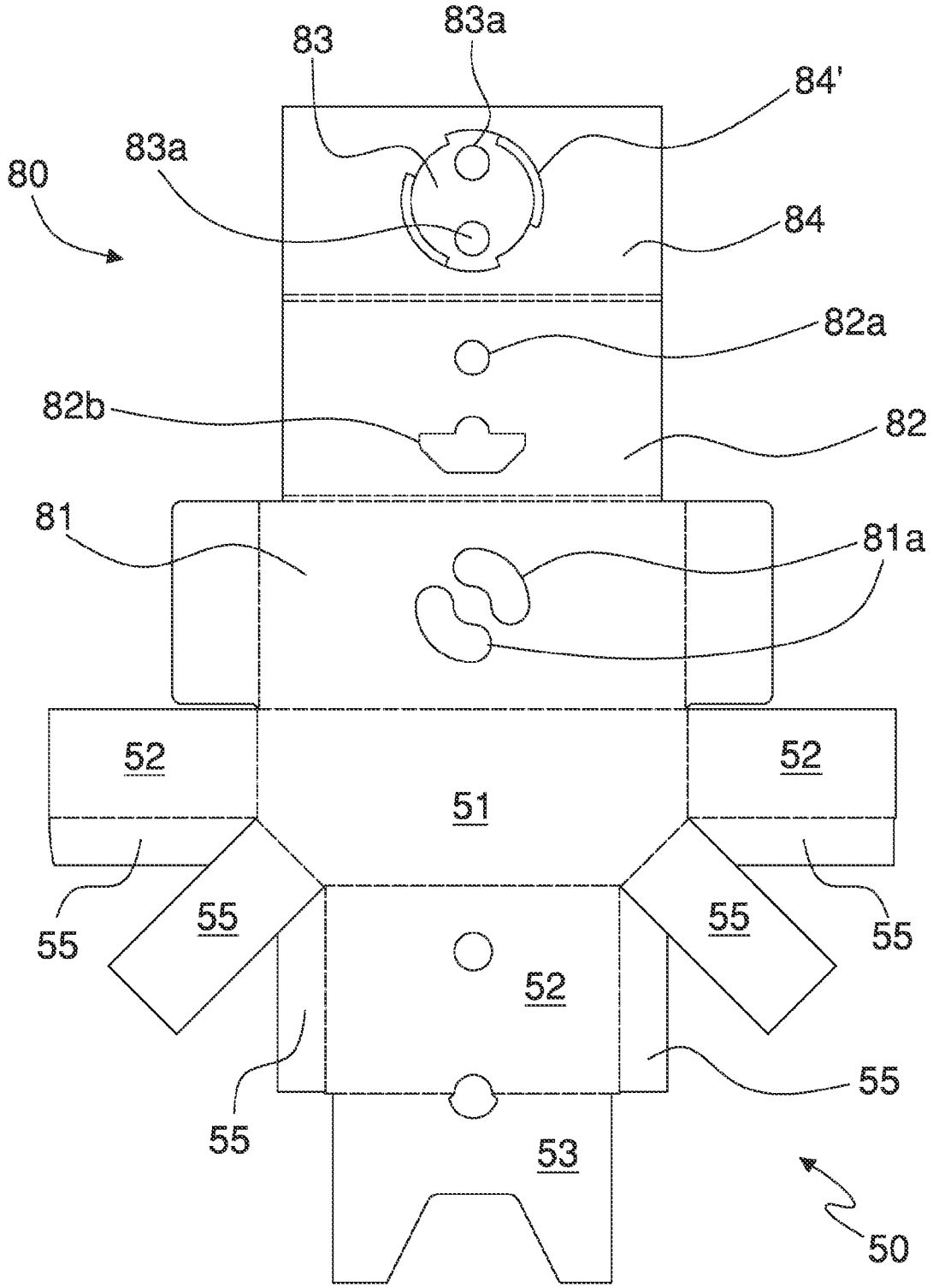
FIG. 14 shows a further blank for making a case of a package.

The wall 60 can also comprise at least one weakening portion 69 configured for defining a locking condition in which the weakening portion itself integrally connects the at least one selector 90 with the at least one intermediate panel 63; in such configuration, the selector 90 is integrally joined to the intermediate panel 63 and is not movable relative to the latter. The weakening portion is configured for being broken following an external stress applied on the selector in order to allow the detachment (the separation) of the selector 90 from the intermediate panel 63 to define a movement condition in which the selector 90 is movable between the first and second operative positions, and vice versa. In fact, the weakening portion essentially defines a sealing element which maintains the selector 90 in a predetermined position until such weakening portion is intentionally broken, for example by a user. Such weakening portion 69 can therefore be employed in order to define a mechanism of the type to show the tampering of an attempted opening (crossing) of the wall 60. For example, if the selector 90 is maintained in the second operative position by the weakening portion, in order to be able to define the through channel the wall 60, a user must break the weakening portion in order to allow the movement of the selector from the second to the first operative position. The weakening portions 69 are schematically visible in the representations of the flat blanks illustrated in FIGS. 1, 3, 11.

In the second embodiment, the wall 60 comprises a first intermediate panel 63*a* and at least one second intermediate panel 63*b* integrally joined by means of a connection edge (see FIG. 7). The first and second intermediate panels are extended along respective development planes that are substantially parallel to each other and parallel to the development planes of the outer panel 61 and of the inner panel 62: the first intermediate panel 63*a* is directly facing and at least partly in direct contact with the second intermediate panel 63*b*. In detail, the first and the second intermediate panel 63*a*, 63*b* are interposed between the outer panel 61 and the inner panel 62. The first intermediate panel 63*a* directly faces the outer panel 61 and is directly interposed between said outer panel 61 and the second intermediate panel 63*b*; the second intermediate panel 63*b* directly faces the inner panel 62 and is directly interposed between said inner panel 62 and the first intermediate panel 63*a* (FIG. 7). In still more detail, the outer panel, the inner panel, the first intermediate panel and the second intermediate panel are joined in a single piece: the wall 60 can be made via folding of the first and second intermediate panels 63*a*, 63*b* in interposition between the outer panel 61 and the inner panel 62.

The first and the second intermediate panel both have a rectangular form, and in particular have the same size. It is however possible to make intermediate panels that are different in shape and size. In the enclosed figures, a wall 60 is illustrated having intermediate panels substantially identical in shape and size to the outer panel 61 and to the inner panel 62.

As is visible in the enclosed figures, the first intermediate panel 63*a* comprises at least one groove 66 adapted to receive the first selector 90*a*; in fact, the groove 66 of the first intermediate panel 63*a*, together with the second selector 90*b* and with the outer panel 61, delimit a seat within which the first selector 90*a* is movable; the groove 66 passes through the thickness of the first intermediate panel 63*a* and the first selector 90*a* is entirely contained within said groove 66. In particular, the groove 66 is delimited by a perimeter edge with closed profile which, visible along a direction orthogonal to the main development plane of the first intermediate panel 63*a*, entirely contains the first selector 90. The groove 66 can have a shape that is substantially rectangular or substantially circular; It is however possible to make a groove 66 having a different form, e.g. square, elliptical, trapezoidal. The first selector 90*a* is at least partially counter-shaped with respect to the perimeter edge of the groove 66 of the first intermediate panel 63*a*: this configuration allows the groove 66 to guide the movement of the first selector 90*a* along the first trajectory between the first and second operative positions. The first intermediate panel 63*a* can also comprise at least one first and one second end stop element configured for limiting the movement of the first selector 90*a* between the first and second operative positions; such end stop elements can alternatively be carried by the outer panel and/or by the inner panel.

In order to internally house the first selector 90, the groove 66 has a passage area larger than the surface area of the first selector 90*a* in a manner such to allow the movement of the first selector itself within the groove 66 between the first and second operative positions. In particular, the ratio between the passage area of the groove 66 and the surface area of the first selector 90 is equal to or larger than 1.05, in particular comprised between 1.1 and 7, still more particularly between 1.1 and 5; the surface area of the first selector 90*a* and the passage area of the groove 66 are measured in the main development plane of the first intermediate panel 63*a* carrying said first selector 90. In particular, the groove 66 is delimited by a perimeter edge with closed profile which, visible along a direction orthogonal to the main development plane of the first intermediate panel 63*a*, entirely contains the first selector 90*a*.

As described above, the first selector 90*a* has a surface area larger than the passage area of the through openings 61*a*, 62*a* of the outer panel 61 and of the inner panel 62; in particular, the outer perimeter edge which defines the surface area of the first selector 90*a*, in the first and in the second operative position of the first selector 90 itself (like also in the intermediate operative positions defined between said first and second operative positions), is configured for containing within its own profile—visible along a direction orthogonal to the development plane of the first selector 90—said through openings 61*a*, 62*a* of the outer and inner panels.

The ratio between the passage area of the groove 66 and the passage area of the through opening 61*a* of the outer panel 61 is larger than 2, optionally equal to or larger than 3, still more optionally comprised between 3 and 15. In the same manner, the ratio between the passage area of the groove 66 and the passage area of the through opening 62*a* of the inner panel 62 is larger than 2, optionally equal to or larger than 3, still more optionally comprised between 3 and 15.

Also the first selector can be connected to the first intermediate panel 63 by means of at least one weakening portion 69 in accordance with that described above. As is visible in the enclosed figures, the second intermediate panel 63*b* comprises at least one groove 67 adapted to receive the second selector 90*b*; in fact, the groove 67 of the second intermediate panel 63*b*, together with the first selector 90*a* and with the inner panel 62, delimit a seat within which the second selector 90*b* is movable; the groove 67 passes through the thickness of the second intermediate panel 63*b* and the second selector 90*b* is entirely contained within said groove 67. In particular, the groove 67 is delimited by a perimeter edge with closed profile which, visible along a direction orthogonal to the main development plane of the second intermediate panel 63*b*, entirely contains the second selector 90*b*. The groove 67 can have a substantially rectangular or substantially circular form; it is however possible to make a groove 67 having a different form, e.g. square, elliptical, trapezoidal. The second selector 90*b* is at least partially counter-shaped with respect to the perimeter edge of the groove 67 of the second intermediate panel 63*b*: this configuration allows the groove 67 to guide the movement of the second selector 90*b* along the second trajectory between the first and second operative positions. The second intermediate panel 63*b* can also comprise at least one first and one second end stop element configured for limiting the movement of the second selector 90*b* between the first and second operative positions; such end stop elements can alternatively be carried by the outer panel and/or by the inner panel.

In order to internally house the second selector 90*b*, the groove 67 has a passage area larger than the surface area of the second selector 90*b* in a manner such to allow the movement of the second selector itself within the groove 67 between the first and second operative positions. In particular, the ratio between the passage area of the groove 67 and the surface area of the second selector 90*b* is equal to or larger than 1.05, in particular comprised between 1.1 and 5, still more particularly comprised between 1.1 and 3; the surface area of the second selector 90*b* and the passage area of the groove 67 are measured in the main development plane of the second intermediate panel 63*b* carrying said second selector 90*b*. In particular, the groove 67 is delimited by a perimeter edge with closed profile which, visible along a direction orthogonal to the main development plane of the second intermediate panel 63*b*, entirely contains the second selector 90*b*.

As described above, the second selector 90*b* has a surface area larger than the passage area of the through openings 61*a*, 62*a* of the outer panel 61 and of the inner panel 62; in particular, the outer perimeter edge which defines the surface area of the second selector 90*b*, in the first and in the second operative position of the second selector 90*b* itself (such as also in the intermediate operative positions defined between said first and second operative positions), is configured for containing within its own profile—visible along a direction orthogonal to the development plane of the second selector 90*b*—said through openings 61*a*, 62*a* of the outer and inner panels.

The ratio between the passage area of the groove 67 and the passage area of the through opening 61*a* of the outer panel 61 is larger than 2, optionally equal to or larger than 3, still more optionally comprised between 3 and 15. In the same manner, the ratio between the passage area of the groove 67 and the passage area of the through opening 62*a* of the inner panel 62 is larger than 2, optionally equal to or larger than 3, still more optionally comprised between 3 and 15. Also the second selector 90*b* can be connected to the first intermediate panel 63*a* by means of at least one weakening portion 69 in accordance with that stated above.

Process for Making the Wall 60

Also forming the object of the present invention is a process for making a wall 60 in accordance with the above-reported description and/or in accordance with the enclosed claims. The process comprises the steps of.

- preparing at least one first flat sheet 81 comprising at least one through notch 81*a*,
- preparing at least one second flat sheet 82 comprising at least one through notch 82*a*,
- preparing at least one third flat sheet 83 comprising at least one through notch 83*a*,
- superimposing the first and second flat sheets 81, 82 in a manner such that the same are substantially parallel to each other such that they can respectively define the outer panel 61 and the inner panel 62 of the wall 60, in which the through notch of the first sheet defines the through opening 61*a* of the outer panel 61 while the through notch of the second sheet defines the through opening 62*a* of the inner panel 62,
- positioning the third sheet 83 in interposition between the first and second sheets superimposed in a manner such that said third sheet defines said selector 90.

Following the step of superimposition of the first and second sheet, the process can comprise a step of constraining said sheets, e.g. by means of gluing, in a manner such to be able to stably maintain the outer panel 61 and the inner panel (formed by the first and second superimposed sheets) engaged with each other and arranged parallel to each other.

The process can also comprise a step of preparing at least one fourth sheet 84 comprising at least one through notch 84*a*; the first sheet 81, the second sheet 82 and the fourth sheet 84 are integrally joined by means of connection edges and aligned along a predetermined direction. The process can comprise a step of folding the first sheet 81, the second sheet 82 and the fourth sheet 84 at the connection edges so as to prepare the fourth sheet in interposition between the first and second sheets: following the folding step—the first, second and fourth sheets respectively define the outer panel 61, the inner panel 62 and the intermediate panel 63 of the wall 60. The through notch 84*a* of the fourth sheet, following the folding step, defines the groove 64 of the intermediate panel 63. In detail, the process comprises a step of cutting the fourth sheet to define on the same the through notch 84*a* during which the third sheet 83 for defining the selector 90 is obtained.

As is visible for example in FIGS. 1, 3, 10-14, 16 and 18, the first sheet 81, the second sheet 82 and the fourth sheet 84 are integrally joined to define a single flat sheet 80; the process comprises a die-cutting step during which the through notches 81*a*, 82*a*, 84*a* are simultaneously executed of the first, second and fourth sheets and the through notch 83*a* of the third sheet obtaining during the notching of the fourth sheet 84: the die-cutting step defines—at the connection edges of the first, second and fourth sheets—creases for the folding of said sheets.

The process, following the die-cutting step, comprises the step of folding said single flat sheet 80 so as to prepare the fourth sheet 84 in interposition between the first and second sheets 81, 82 to define the intermediate panel 63 interposed between the outer panel 61 and the inner panel 62 of the wall 60: the third sheet 83 is folded together with the fourth sheet between the first and second sheets in a manner such to obtain the selector 90 arranged within the groove 64 of the intermediate panel 63.

The step of preparing the at least one fourth sheet 84 comprises the preparation of two fourth sheets 84', 84" integrally joined together by means of a connection edge and respectively integrally joined to the first and second sheet 81, 82: said fourth sheets 84', 84" comprising respective through notches 84*a*', 84*a*". The process comprises the positioning of the fourth sheets in interposition between the first and second sheets 81, 82 folded in a manner such that said two fourth sheets can respectively define the first and the second intermediate panel: the through notches of the two fourth sheets define the grooves 66, 67 of the first and second intermediate panel. The through notches of the fourth sheets allow obtaining the first and second selectors 90*a*, 90*b* from the latter.

The first sheet 81, the second sheet 82 and the two fourth sheets 84', 84" are integrally joined to define the single flat sheet 80. The process comprises a die-cutting step during which the through notches 81*a*, 82*a*, 84*a*', 84*a*" are simultaneously executed of the first, second and two fourth sheets: the die-cutting step defines—at the connection edges of the first, second and two fourth sheets—creases for the folding of said sheets. From the attainment of the notches 84*a*', 84*a*" by means of the die-cutting, two third sheets 83', 83" are attained, respectively adapted to define the first and the second selector 90*a*, 90*b*. The third sheets 83', 83" comprise respective through notches 83*a*', 83*a*" adapted to define the through opening 92 of the first selector 90*a* and the through opening 93 of the second selector 90*b*. Following the die-cutting step, the single flat sheet 80 is folded so as to prepare the two fourth sheets in interposition between the first and second sheets 81, 82 to define the first and the second intermediate panel 63*a*, 63 placed in interposition between the outer panel 61 and the inner panel 62 of the wall 60. The first and second selectors 90*a*, 90*b* obtained from the through notches 84*a*', 84*a*" of the two fourth sheets are folded together with the two fourth sheets between the outer and inner panels.

Package 100

Reference number 100 overall indicates a child-proof package for containing products such as for example: drugs, cosmetics, cleaning products (detergents for linens/sheets and dishes), foods and tobacco-based products (cigars and cigarettes).

The package 100 comprises a container 1 made of sheet material, e.g. paper, defining a compartment 3 for housing at least one product. The container 1 has a predetermined number of lateral walls 4 defining at least one opening 5 delimited by a free edge 6: the opening 5 is configured for allowing the insertion and the removal of the product from the container 1. The container 1 can have a quadrangular prismatic form as illustrated in the enclosed figures, though it is also possible to make a container 1 having different shape. In detail, the container 1 can comprise a lateral front wall 4*a* and a lateral rear wall 4*b* facing and parallel to each other: the front wall 4*a* and the rear wall 4*b* are connected together by means of a first and a second lateral wall 4*c*, 4*d*, also facing and parallel to each other. The front wall 4*a* is distanced and opposite the rear wall 4*b*; the first and second lateral wall 4*c*, $\mathbf{4}_d$ are also spaced and opposite each other. The ends of the front, rear and lateral walls (4*a*, 4*b*, 4*c*, 4*d*) define the opening 5, delimited by the free edge 6. The container 1 also comprises a bottom wall 9 having rectangular shape, from which the lateral walls 4 emerge, starting from a perimeter edge of the bottom wall 9. The container 1 then comprises a single opening 5 defined opposite the bottom wall 9.

The package 100 also comprises a case 102, that can also be made of sheet material, e.g. paper, and having a predetermined number of lateral walls 104 defining at least one access 105 delimited by a free edge 106 configured for allowing the passage of the container 1. The predetermined number of lateral walls 104 of the case 102 delimits an internal volume 103 configured for receiving at least part of the container 1; indeed, the access 105 is configured for placing the internal volume 103 in communication with the external environment, as well as allowing the insertion and the removal of the container 1 from said internal volume 103.

In particular, the case 102 and the container 1 are relatively movable with respect to each other at least between:

- a closed condition in which the case 102 obstructs the opening 5 of the container 1, and
- an open condition in which the case 102 allows the communication between the compartment 3 and the external environment.

The relative movement between case 102 and container 1 can be obtained by moving both parts, i.e. both the case and the container, or it can be obtained by means of the movement of only one of the parts: for example it is possible to maintain fixed the container and only move the case relative to the container. In detail, the container 1, in the closed condition, is at least partly arranged in the internal volume 103: the case 102, in such condition, prevents the insertion and the removal of products from the container. In the open condition, the case 102 allows the removal of the products from the container. As schematized in FIG. 1, the case 102 and the container 1 can be distinct and completely separatable elements. It is however possible to make a case engaged via rotation with the container in a manner such that the same case is still movable between the closed condition and opening, and vice versa.

During the passage from the closed condition to the open condition, and vice versa, the container 1 and the case 102 relatively slide close to or away from each other: during such relative movement, the container 1 is placed at least partly within the case and relatively translates (by movement of at least one between said container and case) in a manner such that the bottom wall 9 of the container 1 is moved close to or away from a top wall 109 of the case 102 from which the predetermined number of lateral walls 104 emerge.

In detail, the case 102 has a structure at least partly counter-shaped with respect to the container 1 in a manner such that, in the closed condition, the case 102 is fit outside the container 1. In detail, the case 102 comprises a front wall 104*a* and a rear wall 104*b* that are opposite each other and connected by means of a first and a second lateral wall 104*c* and 104*d*, also spaced and opposite each other. In detail, also the case 102 has a rectangular prismatic form: the front wall 104*a* and the rear wall 104*b* (with square or rectangular shape) are facing and parallel to each other and connected to each other by means of the first and the second lateral walls 104*c*, 104*d* (with square or rectangular shape) also facing and parallel to each other. In the closed condition:

- the front walls 4*a*, 104*a*, respectively of the container and of the case, directly face each other,
- the rear walls 4*b*, 104*b*, respectively of the container and of the case, directly face each other,
- the first lateral walls 4*c*, 104*c*, respectively of the container and of the case, directly face each other,
- the second lateral walls 4*b*, 104*d*, respectively of the container and of the case, directly face each other.

The case 102 then comprises a single access 105 defined opposite the top wall 109. The top wall 109 is configured for being abutted, in the closed condition, against the free edge 6 of the opening 5 in order to obstruct the latter, as visible in FIG. 6.

As mentioned above, the case 102 is counter-shaped with respect to the container 1. The counter-shaped configuration of the container 1 and the case 102 allows the lateral walls of the case 102 to slide (relatively) externally side-by-side the lateral walls 4 of the container 1 during the passage from the closed condition to the open condition and vice versa. In order to allow such relative movement, the case 102 has a size slightly larger than the container 1, sufficient for allowing the insertion of the latter in the internal volume 103.

The case 102 can comprise the wall 60 which can define at least one lateral wall 104 of the predetermined number of lateral walls of the case 102. In such condition, the outer panel 61 of the wall 60 defines at least one part of an outer surface of the case while the inner panel 62 defines at least one part of an inner surface of the case delimiting said internal volume 103. In the enclosed figures, a configuration of the case is illustrated in which the wall 60 defines the rear wall 104*b* of the case. In such configuration, the selector 90 (optionally the first and the second selector 90*a*, 90*b*) is arranged substantially in the internal volume 103 and movable via sliding within the latter between the first and second operative positions, and vice versa. In fact, the at least one selector is engaged via sliding between an outer wall of the case, defined by the outer panel 61 and an inner wall defined by the inner panel 62.

The package 100 also comprises at least one safety device 11 comprising:

- at least one first coupling portion 12 carried by the case 102 and at least partly arranged in the internal volume 103,
- at least one second coupling portion 13 carried by the container 1 and arranged outside the compartment 3.

The first and second coupling portions 12, 13 are configured for being stably engaged with each other outside the container 1, in the closed condition, to define a locking condition of the safety device 11 in which the first and second coupling portions 12, 13 prevent a container and case from passing from the closed condition to the open condition. The first coupling portion 12 is engaged with the lateral wall 104 of the case 102 defined by the wall 60, i.e. carrying the at least one selector 90 (optionally the first and second selectors). In particular, the first coupling portion 12 is defined on the inner panel 62 of the wall 60 which defines at least one lateral wall 104 of the case.

The first coupling portion 12 comprises at least one tab 12*a* defining an undercut delimited by at least one gripping edge 12*b* entirely placed in the internal volume 103, distinct and distanced from the free edge 106 of the access 105. In detail, the tab 12*a* defines at least one part of the inner panel 62 and hence integrally joined to the lateral wall 104 of the case 104. In detail the tab 12*a*, and hence the gripping edge 12*b*, is obtained by means of cutting, optionally through of the inner panel 62; the undercut delimited by the gripping edge 12*b* is adapted to cooperate with the second coupling portion 13: the gripping edge 12*b* is always distinct and distanced from the free edge 106 of the access 105. The gripping edge 12*b* of the first coupling portion 12 is arranged in interposition between the top wall 109 and the access 105 of the case 102; the gripping edge 12*b* of the first coupling portion 12 has a substantially "V" or "C" shape whose concavity is directed opposite with respect to the free edge 106 of the case 102.

As mentioned above, the safety device 11 can comprise at least one first coupling portion 12. In detail, the safety device 11 can comprise at least one of the following:

- at least one of said first coupling portion 12 carried by the front wall 104*a* of the case 102,
- at least one of said first coupling portion 12 carried by the rear wall 104*b* of the case 102 (in the illustrated condition at least partly by the wall 60),
- at least one of said first coupling portion 12 carried by the first lateral wall 104*c* of the case 102,
- at least one of said first coupling portion 12 carried by the second lateral wall 104*c* of the case 102.

In the enclosed figures, a safety device 11 was for example illustrated, comprising a first coupling portion 12 carried by the front wall 104*a* and at least one respective first coupling portion 12 carried by the rear wall 104*b* defined by the wall 60: said first coupling portions 12 are placed opposite each other. The gripping edge 12*b* of the first coupling portion 12 is arranged in proximity to the through opening 62*a* of the inner panel 62 of the wall 60 of the case 102. As mentioned above, the safety device 11 also comprises at least one second coupling portion 13. In particular, the safety device 11 can comprise only one second coupling portion 13 configured for cooperating con one or more of said first coupling portions 12. Alternatively, the safety device 11 can comprise a second coupling portion 13 for each first coupling portion 12 (configuration illustrated in the enclosed figures).

The second coupling portion 13 is engaged with at least one lateral wall 4 of the container 1 and emerges from the latter according to a direction exiting from the compartment 3. The second coupling portion 13 comprises at least one panel 13*a* projecting from the lateral wall 4 to define an undercut delimited by at least one gripping edge 13*b* placed outside the compartment 3, distinct and distanced from the free edge 6 of the opening 5. The panel 13*a* can have a shape that is substantially triangular or substantially trapezoidal or substantially "V" or "C" shaped: in which the gripping edge 13*b* has at least one section, optionally two rectilinear sections, tilted with respect to the free edge 6 of the opening 5 optionally by an angle comprised between 20° and 80°, still more optionally by an angle comprised between 30° and 70°. In more detail, the free edge 13*b* of the panel 13*a* has a substantially "V" or "C" shape whose concavity is directed towards the free edge 6 of the container. In detail, the panel 13*a* is extended along one plane and directly faces the lateral wall 4 of the container 1 directly carrying the panel 13*a*; the panel 13*a* can be tilted with respect to the lateral wall 4 directly carrying said panel 13*a* by an angle smaller than 40°, optionally by an angle comprised between 1° and 30°. The angle being measured between the surface of the panel 13*a* directly facing the lateral wall 4 and the same lateral wall 4 of the container 1 directly carrying (directly integrally joined) said panel 13*a*. The second coupling portion 13 is defined directly on the lateral wall 4: the second coupling portion forms at least part of the lateral wall 4. In detail, the panel 13*a* is obtained by means of the through cut of the lateral wall 4 in a manner such that, on the same, it is possible to extract the panel 13*a* that is projecting with respect to said lateral wall. In such configuration, the panel 13 can be extended from the lateral wall 4, distanced from the free edge 6, moving away from the latter by an angle smaller than 40°, optionally comprised between 1° and 30°, with respect to the lateral wall 4 from which the same panel 13*a* has been obtained. In detail, the inner panel 13*a* is distinct and distanced from the free edge 6 of the container; in fact, the panel 13*a* is attained by means of notching an outer wall of the same container in a manner such that said panel has an attachment edge 13*c* completely separated (distanced) from the free edge 6 of the container (see for example FIGS. 4 and 5).

Each second coupling portion 13 comprises one and only one panel 13*a* having a shape substantially triangular or in any case pointed adapted to cooperate with the first coupling portion 12.

The safety device 11 can comprise at least one second coupling portion 13. In detail, the safety device 11 can comprise at least one of the following:

- at least one of said second coupling portion 13 carried by the front wall 4*a* of the container 1,
- at least one of said second coupling portion 13 carried by the rear wall 4*b* of the container 1,
- at least one of said second coupling portion 13 carried by the first lateral wall 4*c* container 1,
- at least one of said second coupling portion 13 carried by the second lateral wall 4*c* of the container 1.

In the enclosed figures, a non-limiting configuration of the invention is illustrated in which the safety device 11 comprises a second coupling portion 13 carried by the front wall 4*a* and a respective second coupling portion 13 carried by the rear wall 4*b*: said second coupling portions 13 are placed opposite each other.

In an exemplifying embodiment, the panel 13*a* can comprise at least two portions, each of which configured for being engaged respectively with one of said tabs 12*a* to define the locking condition of the container 1 and of the case 102. Such portions of the panel 13*a* can also have a shape that is substantially triangular or substantially trapezoidal). The gripping edge of each of said portions defines a gripping edge having shape that is substantially "V" shaped whose concavity is directed towards the free edge 6 of the opening 5.

In the configuration illustrated in the enclosed figures, the second coupling portion 13 carried by the front wall 4*a* of the container 1 is configured for cooperating, in the closed condition, with the first coupling portion 12 carried by the front wall 104*a* of the case while the second coupling portion 13 carried by the rear wall 4*b* of the container 1 is configured for cooperating, in the closed condition, with the first coupling portion 12 carried by the rear wall 104*b* of the case. In the closed condition the undercut defined by the panel 13*a* of the second coupling portion 13 is stably engaged with the undercut of the tab 12*a* of the first coupling portion 12 to define said locking condition. In the locking condition, the safety device prevents the case and the container from passing from the closed condition to the open condition. In fact, due to the presence of the first and second coupling portion, the safety device 11 stably maintains the package in the closed condition, preventing the access from outside to the products housed in the container 1.

FIGS. 6 and 7 schematically illustrate the engagement between the first and second coupling portion 12, 13 (locking condition of the safety device 11); as is visible, in the locking condition, the second coupling portion 13 can be at least partly interposed between the first coupling portion 12 and the lateral wall 104 of the case 102, carrying said first coupling portion, to define an undercut adapted to limit the moving away movement between the case 102 and the container 1 so as to prevent the passage from the closed condition to the open condition. Alternatively, in the locking condition, the free edge 13*b* of the panel 13*a* can be at least partly abutted against the gripping edge 12*b* of the first coupling portion 12 to define an undercut adapted to limit the moving away movement between the case 102 and the container 1 so as to prevent the passage from the closed condition to the open condition.

As mentioned above, the package 100 comprises the wall 60 which defines at least part of a lateral wall 104 of the case 102 directly carrying the first coupling portion and hence facing the lateral wall 4 of the container carrying the second coupling portion 13. In such configuration, the selector 90 (optionally the first and the second selector 90*a*, 90*b*) is at least in part facing the second coupling portion 13; the selector 90 (optionally the first and the second selector 90*a*, 90*b*), when arranged in the first operative position, defines the through passage of the wall 60 (hence of the lateral wall 104 of the case 102) adapted to allow, in said closed condition, the access from the external environment to the internal volume 103 of the case in order to allow the unlocking of the first and second coupling portion and the consequent passage of the case and the container from the closed condition to the open condition. In detail, the selector 90 (optionally the first and the second selector 90*a*, 90*b*), when arranged in the first operative position, defines said through opening configured for allowing a user to intervene (manually or also with the suitable opening device adapted to pass through said through opening) from outside the package 100 directly on the panel 13*a* of the second coupling portion 13 in order to allow, in the closed condition of the case and the container, the disengagement of the latter from the first coupling portion 12 and thus allow the passage of the case and the container from the closed condition to the open condition.

In still more detail, the selector 90 is movable from the second to the first operative position in order to define a kind of channel passing through the lateral wall 104 of the case through which a user can access, in the closed condition of the case and the container and from outside the package, the internal volume 103 of the case in order to intervene on the first and/or second coupling portion (in the enclosed figures, a configuration of the package is illustrated in which the user can intervene on the second coupling portion 13) in order to allow the disengagement thereof. The disengagement can occur by means of a thrust action of the panel 13*a* according to a direction entering the compartment 3 of the container in a manner such that said panel 13*a* can be moved away and hence uncoupled from the undercut of the first coupling portion 12.

In fact, the through channel definable by the selector 90 when placed in the first operative position allows a user, at least in the locking condition of the safety device 11, intervention from outside the package 100 directly on at least one of said first and second coupling portions 12, 13 manually and/or by means of an opening device insertable through said through channel, or through the through openings (61*a*, 62*a*, 91) of the outer panel, of the inner panel and of the selector defining the lateral wall of the case.

Vice versa, when the selector 90 (or at least one between the first and second selectors 90*a*, 90*b*) is in the second operative position, the selector 90 itself prevents the communication between the through openings 61*a*, 62*a* of the outer and inner panels in a manner such to prevent a user from accessing, from the external environment, the internal volume 103 of the case (through said through openings) and hence preventing the disengagement between the first and second coupling portions. The safety device 11 and hence configured for preventing a child from opening the package, hence preventing the access to the products contained therein.

The through opening 61*a* of the outer panel 61 is configured for allowing, in the closed condition of the case and the container and from outside the package, intervention on the selector 90 (optionally on the first and second selectors 90*a*, 90*b*) in order to allow the movement thereof from the first to the second operative position, and vice versa. For example, the user through the through opening, during the closed condition of the package, can act thrustingly directly on the panel 13*a* in a manner such to be disengaged from the tab 12*a*; the thrust of the user can occur so as to move the panel 13*a* close to the compartment of the container and away (in disengagement) from the tab 12*a*; in fact, the thrust generated by the user on the panel 13*a* allows moving away the first and second coupling portions until the panel 13*a* is disengaged from the tab 12*a*.

In the enclosed figures, a package 100 was illustrated in which only the lateral rear wall 104*b* is at least partly defined by the wall 60. The package can however comprise a first coupling portion and a second coupling portion respectively carried by the lateral front wall 104*a* of the case and a lateral front wall 4*a* of the container 1. Such coupling portions can be disengaged by means of an unlocking portion 17 configured for defining at least one through access 18 on the lateral front wall 104*a*: the unlocking portion 17 is configured for allowing, at least in the locking condition of the safety device 11, the direct access, from outside the package, to at least one between said first and second coupling portions 12, 13 in order to allow the disengagement thereof and hence allow the passage of the case 102 and the container from the closed condition to the open condition.

Also the unlocking portion 17 is configured for allowing a user, at least in the locking condition of the safety device 11, intervention from outside the package 100 directly on at least one of said first and second coupling portion 12, 13 (in this case carried by the front walls 104*a*, 4*a* of the case and the container) manually and/or by means of an opening device insertable through the through access 18 definable by said unlocking portion. In still more detail, the unlocking portion 17 is configured for allowing, at least in the locking condition of the safety device 11, intervention from outside the package 100 directly on the panel 13*a* of at least one of said second coupling portions 13.

The presence of the unlocking portion 17 essentially defines a second portion through which the user can have access to the internal volume 103 for the disengagement of the coupling portions 12, 13. In other words, the first and second coupling portions 12, 13 carried by the rear lateral walls of the case and the container essentially define a first safety device 11 while the first and second coupling portions 12, 13 carried by the lateral front walls of the case and the container essentially define a second safety device 11; the user has the possibility to intervene on the first safety device through the wall 60 and in particular upon action of the selector 90 in order to define the channel passing through the lateral rear wall 104*b* of the case, while such user has the possibility to intervene on the second safety device through the through access 18 of the unlocking portion 17.

The unlocking portion 17 can comprise a through access 18 defined on the lateral front wall 104*a* of the case 102: the through access 18 is configured for allowing the communication between the external environment and the internal volume 103 and specifically allows a user to reach the panel 13*a* of the second unlocking portion 17 in the locking condition of the safety device 11 and hence in the closed condition of the case and the container.

The package can also comprise at least one tear tab arranged to cover the through opening 61*a* of the wall 60 and hence to cover the selector 90 (optionally of the first and second selector 90*a*, 90*b*, if present); the tear tab is configured for preventing the direct access to the selector 90; the tear tab is configured for being removed from the package in order to show an attempt to access the selector for the opening of the package. If the unlocking portion 17 is also present, the package can comprise a further tear tab placed to cover/close the through access 18.

Process for Making the Package 100

Also forming the object of the present invention is a process for making a package 100 in accordance with one or more of the enclosed claims and/or in accordance with the above-reported description. The process provides for the preparation of the case 102 attainable by means of a first flat blank 50 made of sheet material, optionally paper. The first blank 50 comprises:

- a central sheet 51,
- a predetermined number of lateral sheets 52 integrally joined to the central sheet 51 and emerging from the latter starting from a perimeter edge,
- at least one peripheral sheet 53 engaged with at least one of said lateral sheets 52 opposite the central sheet 51.

The central sheet 51 has a polygonal shape, optionally rectangular or square. From each side of the central sheet 51 is extended a lateral sheet 52, also having a polygonal shape, optionally rectangular or square. The preparation of the case 102 comprises the sub-step of folding the predetermined number of lateral sheets 52 in order to define the predetermined number of lateral walls 104 of the case 102. In detail, the lateral sheets are folded with respect to the central sheet 51 in a manner such that from the flat blank it is possible to obtain a case having three-dimensional shape. The lateral sheets 52 are constrained to each other in a manner such that the case 102 can maintain its three-dimensional form; the lateral sheets 52 can be constrained directly to each other by means of glue or any one adhesive material. Alternatively, the blank 50 can be provided with at least one connection sheet 55 which integrally joins two adjacent lateral sheets 52 (FIG. 2); in such configuration, the process—simultaneously with the folding of the lateral sheets 52—provides for superimposing and joining, e.g. by means of gluing, the connection sheet 55 to adjacent folded lateral sheets: in this manner, the case can maintain its three-dimensional form with the lateral sheets 52 which define the lateral walls 104 and the central sheet to define the top wall 109.

The process also provides for the definition of the at least one first coupling portion 12 by means of the at least one peripheral sheet 53. In detail, the peripheral sheet 53 is integrally joined ad at least one lateral sheet 52 of the first blank 50; the peripheral sheet 53 of the first blank 50 emerges from a perimeter edge of at least one lateral sheet 52 of the first blank 50 itself on the side opposite the central sheet 51 of the first blank. The first coupling portion 12 is made via folding of the peripheral sheet 53 of the first blank 50 on top of the lateral sheet 52 of the same first blank 50 with which said peripheral sheet 53 is integrally joined. Following the folding of the peripheral sheet, at least one part of this is constrained, for example by means of gluing, to a part of the lateral sheet to which it is directly integrally joined (directly to the lateral wall 104). The folding of the at least one peripheral sheet 53 can be executed previously, simultaneously or subsequently with respect to the folding and constraining of the lateral sheets 52.

The process for making the package also comprises the process for making the above-described wall 60 in a manner such that the wall 60 can define at least one lateral wall 104 (in the illustrated case in the enclosed figures, the lateral rear wall 104*b*). As is visible from FIGS. 3, 11, 14, 16 and 18, the first flat sheet 81 is integrally joined to the central sheet 51 of the first blank 50: the second sheet 82 is opposite the central sheet 51 of the first blank on the side opposite the first sheet 81. The process comprises the steps of:

folding the predetermined number of lateral sheets 52, together with the first and second sheets 81, 82 in order to define the at least one lateral wall 104 of the case 102 comprising the first coupling portion 12, positioning the third sheet 83 in interposition between the first and second sheets superimposed in a manner such that said third sheet defines said selector 90.

If the blank 50 also comprises the at least one third and one fourth sheet 83, 84—defined by means of a single die-cutting step—these sheets are folded between the first and second sheets in a manner such that they can define, at the end of the folding of the blank, the intermediate panel 63 and the selector 90.

The central sheet 51, the lateral sheets 52, the peripheral sheet 53, together with the first, second, third and fourth sheets of the first blank 50 can be integrally joined to essentially define a blank of a single sheet obtainable by means of a single step of die-cutting a precursor sheet, e.g. at least partly in paper material. The case 102 is thus obtainable by means of steps of folding and gluing of the single blank (first flat blank 50).

As described above, the case 102 can comprise the unlocking portion 17 which is obtainable by means of the preparation of a notch 56 of at least one lateral sheet 52 of the first blank 50: the notch 56 is of the type passing through the lateral wall 52 and is executed on the lateral wall 52 carrying the peripheral sheet 53. In particular, the notch 56 is executed at the peripheral sheet 53.

The process provides for the preparation of the container 1 attainable by means of a second flat blank 70 made of sheet material, optionally paper. The first blank 70 comprises:

a central sheet 71, a predetermined number of lateral sheets 72 integrally joined to the central sheet 71 and emerging from the latter starting from a perimeter edge, The central sheet 71 has a polygonal shape, optionally rectangular or square. From each side of the central sheet 71, a lateral sheet 72 is extended, it too having a polygonal shape, optionally rectangular or square. The preparation container 1 comprises the sub-step of folding the predetermined number of lateral sheets 72 in order to define the predetermined number of lateral walls 4 of the container 1. In detail, the lateral sheets 72 are folded with respect to the central sheet 71 in a manner such that from the flat blank 70, it is possible to obtain a container 1 having three-dimensional shape. The lateral sheets 72 are constrained to each other in a manner such that the container 1 can maintain its three-dimensional form; the lateral sheets 72 can be constrained directly to each other by means of glue or any one adhesive material. Alternatively, the blank 70 can be provided with at least one connection sheet 75 which integrally joins two adjacent lateral sheets 72; in such configuration, the process—simultaneously with the folding of the lateral sheets 72—provides for the superimposition and the joining, for example by means of gluing, of the connection sheet 75 to adjacent folded lateral sheets 72: in this manner, the container 1 can maintain its three-dimensional form with the lateral sheets 72 which define the lateral walls 4 and the central sheet 71 to define the bottom wall 9.

The process also provides for the definition of the at least one second coupling portion 13. Each second coupling portion 13 can be obtained by means of a step of cutting one of said lateral sheets 72 of the second blank 70 in order to define, directly on said lateral sheet, at least one through notch 76 adapted to define the panel 13*a* of the second coupling portion 13. The second blank 70 can comprise at least one peripheral sheet 73 integrally joined to the lateral sheet 72 carrying the notch 76 for defining the second coupling portion. The peripheral sheet 73 emerges from the lateral sheet to which it is directly integrally joined on the side opposite the central sheet 71, as is visible in FIG. 2. The peripheral sheet 73 is folded on top of lateral sheet 72 of the same second blank 70 to which said peripheral sheet 73 is integrally joined; following the folding, the peripheral sheet 73 is at least partly superimposed and facing the lateral sheet 72 with which it is directly integrally joined. Following the folding of the peripheral sheet 73, at least one part of this is constrained, e.g. by means of gluing, with a part of the lateral sheet 72 to which it is directly integrally joined (directly to the lateral wall 4). The folding of the at least one peripheral sheet 73 can be executed—previously, simultaneously or subsequently—with respect to the folding and constraining of the lateral sheets 72. In one embodiment, the peripheral sheets 73 are folded before the folding of the lateral sheets 72; only following the folding of the peripheral sheets 73, the process provides for the folding and constraining of the lateral sheets 72 in a manner such that, simultaneously with the definition of the lateral walls 4, the definition of the second coupling portion 13 is obtained. The peripheral sheet 73 is configured for defining a support of the lateral sheet 72 carrying the notch 76.

The central sheet 71, the lateral sheets 72 and the possible peripheral sheet 73 (if present) of the second blank 70 can be integrally joined to define a single blank made of a single piece, for example at least partly made of paper material. The container 1 is therefore obtainable by means of steps of folding and gluing of a single sheet blank (first flat blank 70). The second blank 70 can be obtained, by means of one or more of die-cutting steps, a single precursor sheet. The first and second blank 50, 70—although obtainable by means of a step of die-cutting a single sheet—are separate pieces that are machinable, separatable, in order to obtain a case 102 separated from the container 1.

Container

Also forming the object of the present invention is a container for containing products. The container comprises at least one wall 60 in accordance with the above-reported description and/or in accordance with the enclosed claims. The container comprises a storage defining an internal volume and configured for housing one or more products.

The storage comprises a predetermined number of lateral walls defining at least one passage opening delimited by a free edge: the passage opening is configured for placing the internal volume of the storage in communication with the external environment.

The container also comprises a closure system constrained via rotation to the free edge of the storage and movable via rotation relative to the storage between:

- a closed position in which the closure system prevents the communication between the internal volume of the storage and the external environment,
- an open position in which the closure system allows the communication between the internal volume and the external environment.

The container also comprises a safety device comprising a first and a second coupling portion respectively carried by the closure system and a lateral wall of the storage and configured for being stably engaged with each other in the closed condition of the closure system. In particular, the second coupling portion carried by the storage is arranged entirely in the internal volume of said storage and is configured for receiving in engagement the first coupling portion, it too insertable within the storage, in the closed condition of the closure system. The first and second coupling portions are configured for stably maintaining the container in the closed condition and preventing the opening thereof. The container comprises the wall 60 adapted to define at least one part of the wall of the storage directly carrying the second coupling portion. The wall 60 is configured for defining, due to the movement of the selector, the through opening adapted to allow a user to access, from outside the container, the internal volume of the storage in a manner such that the user can act on at least one of said first and second coupling portions in order to allow the disengagement thereof and hence the passage of the closure system from the closed condition to the open condition. In fact, the wall 60 is configured for defining a system for opening the container which allows the user to reach, from outside the container, the coupling portions for the disengagement thereof.

Method for Closing the Package 100

Also forming the object of the present invention is a method for closing a package 100 in accordance with one or more of the enclosed claims and/or in accordance with the above-reported description. The method comprises a first step of positioning the case 102 outside the container 1 in a manner such that the latter can be at least partly housed in the internal volume of the case 102. Before the step of positioning the case 102 outside the container 1—said the case and the container are completely separate and distinct from each other.

Then, the case 102 and the container 1 are moved with respect to each other so as to define the closed condition. The relative movement of the case and the container in the closed condition allows carrying the first coupling portion 12 at the second coupling portion 13 where the two portions can be engaged with each other. The relative movement provides for the relative translation of the case 102 outside the container 1 with the lateral walls 104 of the case 102 strictly facing the lateral walls 4 of the container 1. The relative movement provides for the relative translation of the case 102 with respect to the container 1 up to an end stop position in which the top wall 109 of the case 102 is abutted against the free edge 6 of the container 1 (FIG. 6); in the end stop position, the free edge 106 of the case 102 is arranged at the bottom wall 9 of the container 1. In the end stop position the free edge 6 of the container is abutted against the top wall 109 of the case 102 and prevents a further relative moving closer between the bottom wall 9 of the container 1 and the top wall of the case 102. In the end stop position, the first and second coupling portions 12, 13 are configured for being engaged with each other so as to define the locking condition of the safety device 11.

With relative movement of the case with respect to the container, it is intended the movement of both parts, i.e. the case and the container, or the movement of only one of said parts (only the case 102 or only the container), maintaining stopped the other of the two parts (maintaining fixed the case 102 or the container) in a manner such that a relative motion is defined (the case and the container) between these.

Method for Opening the Package 100

Also forming the object of the present invention is a method for opening a package 100 in accordance with one or more of the enclosed claims and/or in accordance with the above-reported description. Before the execution of the method for opening the package 100, the latter is situated in the locking condition of the safety device.

The opening method comprises a step of moving the at least one selector 90 (optionally of the first and of the second selector 90*a*, 90*b*), in the locking condition and from outside the package 100, from the second to the first operative position so as to define the through opening on the lateral wall of the case 102. Due to the definition of the through opening, the user can contact (manually or by means of a suitable opening device), from outside the package 100, at least one between the first and second coupling portions 12, 13 in order to allow the disengagement. For example, the step of contacting at least one between the first and second coupling portions 12, 13 comprises at least one between the following sub-steps:

- inserting at least one opening device through the through passage of the wall 60,
- manually and directly contacting at least one between the first and second coupling portions 12, 13, for example by means of insertion of a user's finger through the through passage of the wall 60,
- thrustingly act on at least one between the first and second coupling portions so as to distance them and hence disengage them.

The disengagement step comprises the thrust of the second portion of the container 1 in moving closer to the compartment 3, optionally by means of a manual intervention of a user (directly on the second portion 13 or indirectly by means of the elastic deformation of the thrust portion) or by means of an opening device. Following the disengagement of the first and second coupling portion 12, 13, the opening method provides for a relative movement step, moving away the container 1 and the case 102 (condition illustrated in FIGS. 8 and 10) until the open condition of the case 102 is reached. The relative movement can be obtained by moving both the container and the case or it can be executed by maintained stopped one between said container and case and by moving only the other between said container and case.

Of course, if there is a first and a second coupling portion 12, 13 disengageable by means of the unlocking portion, the user, in order to allow the opening of the package 100, must disengage all the first and second coupling portions 12, 13 present on the package through the unlocking portion 17 and through the through opening definable by the selector on the wall 60.

The invention claimed is:

1. A child-proof package comprising:

a container defining a compartment for housing a product, said container having at least one lateral wall defining an opening delimited by a free edge, said opening being configured for allowing the insertion and the removal of the product from the container, a case having at least one lateral wall defining an access delimited by a free edge configured to allow passage of the container, said at least one lateral wall of the case delimiting an internal volume configured to receive at least part of the container, wherein the case and the container are movable relative to each other between: (i) a closed condition wherein the case obstructs the opening of the container, and the container, in said closed condition, is at least partly in the internal volume, and (ii) an open condition wherein the case allows communication between the compartment and an external environment, and a safety device comprising a first coupling portion directly attached to the case and at least partly arranged in the internal volume, and a second coupling portion directly attached to the container and arranged outside the compartment, wherein the first coupling portion and the second coupling portion, in said closed condition, are stably engaged with each other to define a locking condition of the safety device wherein said first coupling portion and the second coupling portion prevent the case and the container from passing from the closed condition to the open condition, wherein at least part of the lateral wall of the case comprises:

an outer panel made of sheet material and comprising a through opening, an inner panel made of sheet material and engaged with the outer panel, wherein the inner panel comprises a respective through opening, wherein said lateral wall of the case comprises a selector made of sheet material engaged in interposition between the outer panel and the inner panel, wherein said selector comprises a through opening and is configured to move with respect to said outer panel and the inner panel between:

a first operative position wherein the through opening of the selector is at least partly facing the through openings of the outer panel and the inner panels, wherein the through openings define a single passage passing through the lateral wall, and a second operative position wherein the through opening of the selector is distanced with respect to at least one of said through openings of the outer panel and the inner panel, wherein the selector, in the second operative position, prevents communication between the through openings of the outer panel and the inner panel, and wherein the selector, when arranged in the first operative position, defines the through passage of said lateral wall of the case to allow, in said closed condition, access of the external environment to the internal volume of the case to allow unlocking of the first coupling portion and the second coupling portion, and the consequent passage of the case and the container from the closed condition to the open condition.

2. The child-proof package according to claim 1, wherein the outer panel and the inner panel extend along respective development planes parallel to each other, and wherein the selector is movable between the first operative position and the second operative position along a trajectory lying on a plane parallel to at least one of the development plane of the outer panel and the inner panel.

3. The child proof package according to claim 1, wherein the surface area of the selector is larger than an extension of the through opening of the inner panel, said extension of the through opening of the inner panel being measured along the development plane of the inner panel or of the selector.

4. The child proof package according to claim 1, wherein the through opening of the selector, in the first operative position of the latter, is at least partly aligned with the through openings of the outer panel and the inner panel along a direction orthogonal to a development plane of at least of: the outer panel, the inner panel and the selector.

5. The child proof package according to claim 1, wherein the through opening of the selector has a passage area smaller than a passage area of the through opening of the outer panel, said passage area of the through opening of the selector and the passage area of the through opening of the outer panel being measured with respect to a development plane of the selector and/or of the outer panel.

6. The child proof package according to claim 1, wherein the outer panel defines at least part of an outer lateral surface of the case, and the inner panel defines at least part of an inner lateral surface of the case, at least partly delimiting the internal volume of said case, and wherein the through opening of the outer panel allows, in the closed condition of the case and the container and from outside the package, intervention on the selector to allow movement between the first operative position and the second operative position.

7. The child proof package according to claim 1, wherein the through opening of the inner panel of the lateral wall of the case is arranged in correspondence of at least one of the first and second coupling portions.

8. The child proof package according to claim 1, wherein the through openings, respectively of the outer panel and of the selector, in the first operative position of the selector are at least partly aligned with the through opening of the inner panel to define said through opening.

9. The child proof package according to claim 1, wherein the first coupling portion is defined on the inner panel of the lateral wall of the case, the first coupling portion comprises at least one tab defining an undercut delimited by at least one gripping edge configured for being abutted, in the closed condition of the case and the container, against the second coupling portion of the container in order to define said locking condition.

10. The child proof package according to claim 1, wherein the second coupling portion comprises at least one panel engaged with the lateral wall of the container and emerging from said lateral wall according to a direction exiting from the compartment, wherein the panel of the second coupling portion defines an undercut delimited by at least one gripping edge placed outside the compartment, spaced from the free edge of the opening of the container itself, and wherein the undercut defined by the panel of the second coupling portion, in the closed condition of the case and the container, is stably engaged with the undercut of the first coupling portion to define said locking condition.

11. The child proof package according to claim 1, wherein the selector, when arranged in the first operative position, defines said through opening configured to allow a user to intervene from outside the package directly on the panel of the second coupling portion to allow, in the closed condition of the case and the container, disengagement of the container from the first coupling portion and allow the passage of the case and the container to move from the closed condition to the open condition.

12. A child-proof package comprising:

a container defining a compartment for housing a product, said container having at least one lateral wall defining an opening delimited by a free edge, said opening being configured for allowing the insertion and the removal of the product from the container, a case having at least one lateral wall defining an access delimited by a free edge configured to allow passage of the container, said at least one lateral wall of the case delimiting an internal volume configured to receive at least part of the container, wherein the case and the container are movable relative to each other between: (i) a closed condition wherein the case obstructs the opening of the container, and the container, in said closed condition, is at least partly in the internal volume, and (ii) an open condition wherein the case allows communication between the compartment and an external environment, and a safety device comprising a first coupling portion carried by the case and at least partly arranged in the internal volume and a second coupling portion carried by the container and arranged outside the compartment, wherein the first coupling portion and the second coupling portion, in said closed condition, are stably engaged with each other to define a locking condition of the safety device wherein said first coupling portion and the second coupling portion prevent the case and the container from passing from the closed condition to the open condition, wherein at least part of the lateral wall of the case comprises:

an outer panel made of sheet material and comprising a through opening, an inner panel made of sheet material and engaged with the outer panel, wherein the inner panel comprises a respective through opening, wherein said lateral wall of the case comprises a selector made of sheet material engaged in interposition between the outer panel and the inner panel, wherein said selector comprises a through opening and is configured to move with respect to said outer panel and the inner panel between:

a first operative position wherein the through opening of the selector is at least partly facing the through openings of the outer panel and the inner panels, wherein the through openings define a single passage passing through the lateral wall, and a second operative position wherein the through opening of the selector is distanced with respect to at least one of said through openings of the outer panel and the inner panel, wherein the selector, in the second operative position, prevents communication between the through openings of the outer panel and the inner panel, wherein the selector, when arranged in the first operative position, defines the through passage of said lateral wall of the case to allow, in said closed condition, access of the external environment to the internal volume of the case to allow unlocking of the first coupling portion and the second coupling portion, and the consequent passage of the case and the container from the closed condition to the open condition, wherein the lateral wall of the case comprises an intermediate panel between the outer panel and the inner panel, wherein the intermediate panel on one side faces the outer panel and on an opposite side faces the inner panel, wherein the intermediate panel comprises a groove configured to receive the selector, and wherein the groove of the intermediate panel, with the inner panel and the outer panel, delimit a seat within which the selector is movable.

13. The child proof package according to claim 12, wherein the intermediate panel extends along a development plane substantially parallel to at least one of the development planes of the outer and inner panels, and wherein the groove of the intermediate panel has a passage area larger than the surface area of the selector to allow the movement of the selector within the groove between the first and second operative positions, wherein the surface area of the selector and the passage area of the groove are measured in the main development plane of the at least one intermediate panel carrying said selector.

14. The child proof package according to claim 13, wherein a ratio between the passage area of the groove and the surface area of the selector is in a range of 1.1 to 5.

15. A child-proof package comprising:

a container defining a compartment for housing a product, said container having at least one lateral wall defining an opening delimited by a free edge, said opening being configured for allowing the insertion and the removal of the product from the container, a case having at least one lateral wall defining an access delimited by a free edge configured to allow passage of the container, said at least one lateral wall of the case delimiting an internal volume configured to receive at least part of the container, wherein the case and the container are movable relative to each other between: (i) a closed condition wherein the case obstructs the opening of the container, and the container, in said closed condition, is at least partly in the internal volume, and (ii) an open condition wherein the case allows communication between the compartment and an external environment, and a safety device comprising a first coupling portion carried by the case and at least partly arranged in the internal volume, and a second coupling portion carried by the container and arranged outside the compartment, wherein the first coupling portion and the second coupling portion, in said closed condition, are stably engaged with each other to define a locking condition of the safety device wherein said first coupling portion and the second coupling portion prevent the case and the container from passing from the closed condition to the open condition, wherein at least part of the lateral wall of the case comprises:

an outer panel made of sheet material and comprising a through opening, an inner panel made of sheet material and engaged with the outer panel, wherein the inner panel comprises a respective through opening, wherein said lateral wall of the case comprises a selector made of sheet material engaged in interposition between the outer panel and the inner panel, wherein said selector comprises a through opening and is configured to move with respect to said outer panel and the inner panel between:

a first operative position wherein the through opening of the selector is at least partly facing the through openings of the outer panel and the inner panels, wherein the through openings define a single passage passing through the lateral wall, and a second operative position wherein the through opening of the selector is distanced with respect to at least one of said through openings of the outer panel and the inner panel, wherein the selector, in the second operative position, prevents communication between the through openings of the outer panel and the inner panel, wherein the selector, when arranged in the first operative position, defines the through passage of said lateral wall of the case to allow, in said closed condition, access of the external environment to the internal volume of the case to allow unlocking of the first coupling portion and the second coupling portion, and the consequent passage of the case and the container from the closed condition to the open condition, and wherein the selector extends along a main development plane and has a surface area larger than a passage of the through opening of the outer panel, said passage area of the through opening of the outer panel being measured along the development plane of the outer panel.

16. A child-proof package comprising:

a container defining a compartment for housing a product, said container having at least one lateral wall defining an opening delimited by a free edge, said opening being configured for allowing the insertion and the removal of the product from the container, a case having at least one lateral wall defining an access delimited by a free edge configured to allow passage of the container, said at least one lateral wall of the case delimiting an internal volume configured to receive at least part of the container, wherein the case and the container are movable relative to each other between: (i) a closed condition wherein the case obstructs the opening of the container, and the container, in said closed condition, is at least partly in the internal volume, and (ii) an open condition wherein the case allows communication between the compartment and an external environment, and a safety device comprising a first coupling portion carried by the case and at least partly arranged in the internal volume, and a second coupling portion carried by the container and arranged outside the compartment, wherein the first coupling portion and the second coupling portion, in said closed condition, are stably engaged with each other to define a locking condition of the safety device wherein said first coupling portion and the second coupling portion prevent the case and the container from passing from the closed condition to the open condition, wherein at least part of the lateral wall of the case comprises:

an outer panel made of sheet material and comprising a through opening, an inner panel made of sheet material and engaged with the outer panel, wherein the inner panel comprises a respective through opening, wherein said lateral wall of the case comprises a selector made of sheet material engaged in interposition between the outer panel and the inner panel, wherein said selector comprises a through opening and is configured to move with respect to said outer panel and the inner panel between:

a first operative position wherein the through opening of the selector is at least partly facing the through openings of the outer panel and the inner panels, wherein the through openings define a single passage passing through the lateral wall, and a second operative position wherein the through opening of the selector is distanced with respect to at least one of said through openings of the outer panel and the inner panel, wherein the selector, in the second operative position, prevents communication between the through openings of the outer panel and the inner panel, wherein the selector, when arranged in the first operative position, defines the through passage of said lateral wall of the case to allow, in said closed condition, access of the external environment to the internal volume of the case to allow unlocking of the first coupling portion and the second coupling portion, and the consequent passage of the case and the container from the closed condition to the open condition, and wherein the through opening of the selector is delimited by a perimeter edge defining a gripping portion of the selector which can be contacted by the user through the through opening of at least one of the outer panel and the inner panel for the manual movement of the selector between the first operative position and the second operative position.

* * * * *